US011332293B2

(12) United States Patent
Oh

(10) Patent No.: US 11,332,293 B2
(45) Date of Patent: May 17, 2022

(54) CONTAINER DEVICE CAPABLE OF STORING LIQUID AND MANUFACTURING METHOD THEREOF

(71) Applicant: INNERBOTTLE CO., LTD., Seongnam-si (KR)

(72) Inventor: Sea Il Oh, Suwon-si (KR)

(73) Assignee: INNERBOTTLE CO., LTD., Seongnam-si (KR)

( * ) Notice: Subject to any disclaimer, the term of this patent is extended or adjusted under 35 U.S.C. 154(b) by 0 days.

(21) Appl. No.: 16/477,876

(22) PCT Filed: Nov. 16, 2018

(86) PCT No.: PCT/KR2018/014071
§ 371 (c)(1),
(2) Date: Jul. 13, 2019

(87) PCT Pub. No.: WO2019/098734
PCT Pub. Date: May 23, 2019

(65) Prior Publication Data

US 2019/0367236 A1 Dec. 5, 2019

(30) Foreign Application Priority Data

Nov. 17, 2017 (KR) ..... 10-2017-0154034
Nov. 20, 2017 (KR) ..... 10-2017-0155139
(Continued)

(51) Int. Cl.
*B65D 23/02* (2006.01)
*B65D 77/06* (2006.01)
(Continued)

(52) U.S. Cl.
CPC ..... *B65D 77/06* (2013.01); *B65B 3/04* (2013.01); *B65D 83/0061* (2013.01)

(58) Field of Classification Search
CPC .... B65D 77/06; B65D 83/0061; B65D 83/62; B65B 3/04
(Continued)

(56) References Cited

U.S. PATENT DOCUMENTS 2,678,764 A * 5/1954 Carlson ..... B65D 25/16 141/390
8,479,779 B2 * 7/2013 Behar ..... B65D 83/0061 141/3
(Continued)

FOREIGN PATENT DOCUMENTS

FR 2785594 * 5/2000 ..... B65D 83/34
JP 07-022988 U 4/1995
(Continued)

OTHER PUBLICATIONS

Extended European Search Report dated Jun. 21, 2021 for European Application No. 18878972.1.

*Primary Examiner* — Don M Anderson
*Assistant Examiner* — Elizabeth J Volz
(74) *Attorney, Agent, or Firm* — Insight Law Group, PLLC; Seung Lee

(57) ABSTRACT

The present disclosure relates to a container device capable of storing and discharging liquid.
A container device according to the present disclosure includes a pouch having the elastic property; a rigid container having a rigid outer case compared to the pouch and having a container opening at one side thereof; a coupling unit coupled to the container opening and for coupling an opening of the pouch with the container opening; and an air passage formed at the rigid container or the coupling unit. When the pressure is applied to the inside of the pouch and the volume of the pouch is increased, the volume of a space between the pouch and the rigid container is reduced by an increase in the volume of the pouch, such that the air in the
(Continued)

space is discharged to the outside of the rigid container through the air passage to perform the depressurization of the space.

6 Claims, 36 Drawing Sheets

(30) Foreign Application Priority Data

Dec. 21, 2017 (KR) ..... 10-2017-0177152
Dec. 21, 2017 (KR) ..... 10-2017-0177153
Dec. 26, 2017 (KR) ..... 10-2017-0179548

(51) Int. Cl.
*B65B 3/04* (2006.01)
*B65D 83/00* (2006.01)

(58) Field of Classification Search
USPC ..... 215/902; 220/495.04
See application file for complete search history.

(56) References Cited

U.S. PATENT DOCUMENTS

| | | | |
|---|---|---|---|
| 2010/0108192 | A1 | 5/2010 | Mackenzie et al. |
| 2012/0024419 | A1 | 2/2012 | Behar |

FOREIGN PATENT DOCUMENTS

| | | | |
|---|---|---|---|
| JP | 2004-042928 | A | 2/2004 |
| JP | 2005-201380 | A | 7/2005 |
| KR | 20-0289892 | Y1 | 9/2002 |
| KR | 10-2006-0090790 | A | 8/2006 |
| KR | 10-2010-0112650 | A | 10/2010 |
| KR | 10-2012-0036953 | A | 4/2012 |
| KR | 10-2013-0013831 | A | 2/2013 |
| KR | 10-2013-0099153 | A | 9/2013 |
| KR | 10-2013-0141758 | A | 12/2013 |
| KR | 10-1469765 | B1 | 12/2014 |
| KR | 10-2016-0032057 | A | 3/2016 |
| KR | 10-2016-0038890 | A | 4/2016 |
| WO | 2015/006738 | A1 | 1/2015 |

* cited by examiner

CROSS-SECTIONAL DIAGRAM TAKEN ALONG THE LINE A-A

CONTAINER DEVICE CAPABLE OF STORING LIQUID AND MANUFACTURING METHOD THEREOF

CROSS-REFERENCE TO RELATED APPLICATIONS

This application is a National Phase Entry of International Application No. PCT/KR2018/014071, filed on Nov. 16, 2018, which claims priority and benefits of Korean Application Nos. 10-2017-0154034, filed on Nov. 17, 2017, 10-2017-0155139, filed on Nov. 20, 2017, 10-2017-0177152, filed on Dec. 21, 2017, 10-2017-0177153, filed on Dec. 21, 2017, 10-2017-0179548, filed on Dec. 26, 2017, the content of which is incorporated herein by reference in their entirety.

TECHNICAL FIELD

The present disclosure relates to a container device capable of storing and discharging liquid, and more particularly, to a container device capable of storing and discharging liquid which allows full consumption of content in a container without any remaining liquid while easily injecting the content even without adding a separate facility to a typical manufacturing facility.

BACKGROUND ART

FIG. 1A is a view illustrating a container device for liquid content according to the related art, and FIG. 1B is a view illustrating a container device having only a small amount of the residual content therein for the liquid content with high viscosity according to the related art.

The container device for the liquid content illustrated in FIG. 1A, is the one widely used conventionally and generally with a dispenser such as an air pump which is attached to its opening. The container device illustrated in FIG. 1A has been widely used in various industries such as shampoo, lotion, detergent and food, etc., mainly because of its advantage of capability of discharging the liquid in the container with only one hand as the container device stands.

The container device for the liquid illustrated in FIG. 1A can contain various types of contents. When the amount of the remaining content 20 is small in case of the liquid with viscosity such as shampoo, lotion, or syrup, the content 20 tends to adhere to the wall surfaces of the container, and do not easily fall off therefrom as illustrated in FIG. 1B. The problem becomes even more prominent if the viscosity of the content is high.

There has been a problem that, when the container device for the liquid content conventionally used generally discharges the content by attaching a discharging tube 31 to a dispenser such as an air pump, it is difficult to discharge it because residual content 21 is not easily taken off from the container 10 when the content sticks to internal walls of the container 10, and particularly, as the volume of the container 10 becomes larger, the surface area thereof also becomes larger, such that the amount of the residual content 21 sticking to the internal walls increases, and as a result, it is impossible to discharge the content through the dispenser such as an air pump to consume it up.

That is, in the case of the container device for the liquid content conventionally used, as illustrated in FIG. 1B, since the discharging tube 31 attached to the dispenser is disposed at a certain position, the residual content 21 in a region which cannot be sucked by the discharging tube 31 of the internal wall or the bottom surface of the container is not effectively discharged, and as a result, a typical container device for the liquid content have had the following serious problems.

Firstly, the unconsumed content which is out of reach still remains in the rigid container, and the content cannot be consumed completely and discarded, thereby causing unnecessary waste of resources.

Secondly, a discarded container may still contain content such as lotion, shampoo, and detergent, which may cause environmental pollution.

Thirdly, when a discharger such as a pump is disassembled from the container to open a discharging port in order to consume the residual content in the container not discharged to the discharger, the content can be contaminated due to foreign substances, etc. introduced from outside.

Fourthly, it is difficult to precisely discharge a wanted amount of content when a user disassembles the discharger from the container and attempts to discharge by turning over and shaking them in order to discharge the residual content in the container.

Nonetheless, the inventor of the present disclosure has recognized that it is very important to solve the above-mentioned problems because, not only the liquid with high viscosity, such as shampoo, lotion or syrup, but also even the liquid with very low viscosity are sold while filled in the container device of the form illustrated in FIGS. 1A and 1B due to esthetic reasons, convenience of use, etc. The inventor has also recognized a problem causing the serious environmental pollution that the problem operates not only as a serious obstacle to neatly consuming the content such as shampoo and lotion but also the recycle is possible only after discarding the container 10 or removing all residual content therein while not all of the content 20 is consumed.

Therefore, there has been a need for a storing and discharging device for liquid content, which allows full consumption of the content 20 by providing a pouch in the container 10 and storing the content 20 in the pouch to reduce the internal surface area of a storing space in which the content 20 contacts by contracting the pouch according to the use thereof. However, it has been recognized that the requirement that it should be applied to a typical filling and manufacturing facility without modification is an important one for actually utilizing the spirit of the present disclosure in that the relevant industrial field is a field in which not only the practicality of the container itself but also the aesthetics and the possibility of mass production of the container should be considered at the same time.

Meanwhile, as a conventionally used technique for fully consuming the content in the container, a so-called airless container, in which the bottom surface of the container is lifted by the pressure as the content in the container are reduced, has been developed, but there has been a serious problem that it is difficult for airless containers to be widely used in the cosmetics industry, in which the use of various types of containers are required, because the airless container can have only a cylinder shape and is limited in terms of esthetic sense, and it cannot be applied to a large capacity because of a limitation in implementing the cylinder size.

Furthermore, while Korean Utility Model Registration No. 0289892 discloses a container device having a rubber balloon in the container as related art to achieve a similar purpose, the disclosure provides that it is necessary to provide the opening of the container having a narrow inlet and discharge the content in a rubber balloon through a valve by recognizing a problem that the content is discharged by the backflow and not stored therein when injecting the content into the container by the restoring force of the rubber balloon. It was also recognized that the limitation is very restrictive to utilize the corresponding spirit of the disclosure in the actual relevant industrial field, and furthermore, there has been a problem that it cannot be applied to a general manufacturing method.

That is, according to Korean Utility Model Registration No. 0289892, there has been a problem that in order to inject the content into the rubber balloon, the injection pressure of the liquid should be larger than the restoring force of the rubber balloon due to the restoring force of the rubber balloon, and for this purpose, the content injection nozzle and the opening of the container should be air-tightly contacted and coupled, and in this case, it takes a lot of time to inject the content because the opening of the container is narrow.

There has been a problem that Korean Utility Model Registration No. 0289892 cannot be used for a mass production method in that the content should be easily injected for mass production. Particularly, Korean Utility Model Registration No. 0289892 has had a limitation that cannot be applied to a typical liquid content injection method in that a typical liquid content injection method (bottling) is a method of spraying the content into the container while the injection nozzle is not air-tightly contacted with the container.

Therefore, an introduction of the container device and the container device manufacturing method, which can effectively inject and discharge the content with viscosity even while keeping esthetic sense and convenience by using the rigid container, is required. Furthermore, development is required for the container device and the container device manufacturing method, which can effectively inject the content into a flexible pouch with the elasticity even while utilizing a typical liquid injection facility without modification.

DISCLOSURE

Technical Problem

The inventor of the present disclosure has recognized a problem that, when liquid, particularly, liquid with high viscosity is filled in a rigid container, the liquid content tends to stick to internal walls of the container due to high viscosity and surface tension of the liquid content, and are not easily discharged using the dispenser (the discharger) such as a pump which renders usage of the dispenser impractical. Not only a container using a discharger but also a container for discharging content by squeezing the container by hand, such as ketchup has same problem. Nevertheless, the inventor of the present disclosure has well recognized the voices of the relevant industries that it is necessary to use a rigid container having a uniform shape due to the reason of making the product look better for esthetic reasons, and the advantage capable of using by attaching the pump, etc. to the discharging portion for convenience of use.

Therefore, development has been made for the container device and the container device manufacturing method, which can utilize the content filling method without modification according to a typical mass production method because the liquid content in the rigid container can be completely used even while using the rigid container having a rigid case without modification.

FIGS. 2A and 2B are views illustrating a typical liquid content filling method and procedure generally used in the relevant industries in manufacturing a liquid content product such as shampoo or lotion.

As illustrated in FIGS. 2A and 2B, a procedure of filling the content into the rigid container in the mass production procedure of the liquids product conventionally used accompanies a procedure of spraying the content from the nozzle to charge the content into the container when empty containers sequentially move to a filling equipment along a conveying apparatus 50 such as a conveyor belt 51 and positioned below the nozzle of the filling equipment. At this time, the content filling equipment can have one or multiple nozzles 60 depending on the design.

As illustrated in FIG. 2B, when the containers are disposed below the nozzle to fit the number of the nozzles, the nozzle is lowered to charge the content above each opening of the rigid container 61. At this time, the moving time of the nozzle for filling the content and the filling amount per unit time of the nozzle are directly related to the production efficiency of the product, and therefore, the nozzle generally sprays the content while moving vertically only by a minimum distance or at its position without the movement according to the designing method so that the content can be precisely sprayed into the rigid container. Therefore, upon considering the production efficiency, etc., the nozzle and the opening of the rigid container is not air-tightly contacted, but are close to each other only by the extent that the content can be sprayed into the container, thereby performing the filling.

Meanwhile, the inventor of the present disclosure has recognized a problem that, when the content is charged into the pouch through the content filling method generally used for the mass production method, upon considering the elasticity and the restoring force of the pouch, the injection pressure applied by the content injected into the pouch cannot overcome the elasticity and the restoring force of the pouch when the content injection nozzle is not in close contact with the opening of the rigid container, thereby not containing the content by the volume of the rigid container as long as the pouch has not been previously inflated and expanded, and has recognized that this operates as a great obstacle in implementing the method for filling the liquid content into the rigid container having the pouch in the mass production method.

Therefore, development has been required for the container device and the manufacturing method thereof, which can use a new method capable of filling the liquid content into the rigid container having the pouch even while using a typical content filling facility without modification considering the economic efficiency and the mass production capability.

Therefore, an object of the present disclosure is to provide a device, a container, and a manufacturing method thereof, which can use all content without remaining even when containing the liquid content in a container device capable of storing and discharging liquid, and apply it to a typical manufacturing process.

Another object of the present disclosure is to provide a device, a container, and a manufacturing method thereof, which can have the pouch that can be inserted into the container to charge and store the content therein, contain the content therein regardless of the form of the container because the deformation is possible to fit in the case of the container by expanding the pouch, and apply the pressure at which the elastic flexible pouch always pushes the content toward the opening by the elasticity (the restoring force) of the pouch, thereby using the improved and cost-saving discharger.

Still another object of the present disclosure is to provide a device, a container, and a manufacturing method thereof, which can secure the storing space by the volume of the container by expanding the pouch before filling the content in filling the content into the container having the pouch, thereby applying it to a typical content filling equipment by injecting the content therein even if the content filling nozzle and the opening of the rigid container is not completely and air-tightly contacted.

Yet another object of the present disclosure is to provide a device, a container, and a manufacturing method thereof, which can expand the pouch in the container before filling the content, thereby minimizing the unnecessary process and the structure and minimizing the manufacturing cost.

The objects of the present disclosure are not limited to the above-mentioned objects, and other objects not described can be clearly understood by those skilled in the art from the following description.

Technical Solution

A container device capable of storing liquid according to an embodiment of the present disclosure includes: a pouch having an elastic property; a rigid container having a rigid case compared to the pouch and having a container opening at one side thereof; a coupling unit coupled to the container opening and for coupling an opening of the pouch with the container opening; and an air passage formed at the rigid container or the coupling unit. When a pressure is applied to an inside of the pouch and a volume of the pouch is increased, a volume of a space between the pouch and the rigid container is reduced by an increase in the volume of the pouch, such that air in the space is discharged to the outside of the rigid container through the air passage to perform the depressurization of the space.

In addition, the container device capable of storing liquid may further include an air passage cap configured to seal the air passage. The air passage cap may seal the air passage to keep the depressurized state of the space.

In addition, the pouch may be inflated to fit in the case of the rigid container when the air in the space is discharged to the outside of the rigid container through the air passage.

In addition, a wrinkle pattern may be provided on at least a portion of the pouch.

In addition, the coupling unit may be inserted into and fixed to the container opening of the rigid container.

In addition, the coupling unit may include an upper unit and a lower unit, and the upper unit may be connected to communicate with the pouch, and the lower unit may be coupled to the upper unit on the pouch.

In addition, the coupling unit may include a single body, and may include a pouch binding portion and a coupling unit fixing portion.

A manufacturing method of a container device according to another aspect of an embodiment of the present disclosure includes: coupling a pouch to a coupling unit so that the coupling unit and the pouch communicate with each other; inserting and fixing the coupling unit coupled with the pouch into an opening of a rigid container so that the opening of the rigid container and an opening of the pouch can be air-tightly contacted and coupled; expanding the pouch by injecting gas into the pouch coupled to the opening of the rigid container; performing depressurization for a space between the pouch and the rigid container by discharging the air in the space to the outside of the rigid container through an air passage as the pouch expands; and terminating the depressurization for the space by stopping the gas injection into the pouch when the pouch is expanded to a certain size or more in the rigid container.

In addition, the manufacturing method of the container device may further include keeping the pouch expanded in the rigid container by sealing the air passage using an air passage cap to keep the space between the pouch and the rigid container in the depressurized or vacuum state.

In addition, the manufacturing method of the container device may further include filling the content into the pouch which is expanded in the rigid container.

In addition, a manufacturing method of a container device according to still another aspect of an embodiment of the present disclosure includes coupling a pouch to a rigid container by way of high frequency welding or an adhesive application after contacting an opening of the pouch to an opening of the rigid container; expanding the pouch by injecting gas into the pouch coupled to the opening of the rigid container; performing depressurization for a space between the pouch and the rigid container by discharging the air in the space to the outside of the rigid container through an air passage as the pouch expands; and terminating the depressurization for the space by stopping the gas injection into the pouch when the pouch is expanded to a certain size or more in the rigid container.

Advantageous Effects

The present disclosure is intended to solve the above problems, and the container device according to the present disclosure provides a device, a container, and a manufacturing method thereof, which can use all content without remaining by containing the liquid with viscosity therein.

It is possible for the device, the container, and the manufacturing method thereof according to an embodiment of the present disclosure to have the elastic pouch that can be inserted into the rigid container, thereby effectively using the residual content by using the pressure at which the elastic pouch pushes the content toward the opening by the reduction effect of the surface area according to the contraction of the elastic pouch and the elasticity (the restoring force) of the elastic pouch and the discharging pressure of the discharging device, and can be deformed into various shapes in which the rigid container can have when the elastic pouch has been inflated by the elasticity of the elastic pouch, thereby designing the container regardless of the shape of the rigid container.

It is possible for the device, the container, and the manufacturing method thereof according to an embodiment of the present disclosure to inject the content therein by using a typical content filling method even while having the elastic pouch because the content cannot be injected therein by the volume of the rigid container by the elasticity of the elastic pouch while the elastic pouch is not expanded in advance, when using a method in which the filling nozzle sprays or flows the content above the opening of the rigid container as in a typical method in filling the content into the rigid container provided with the elastic pouch.

BEST MODE

Figure 1A:
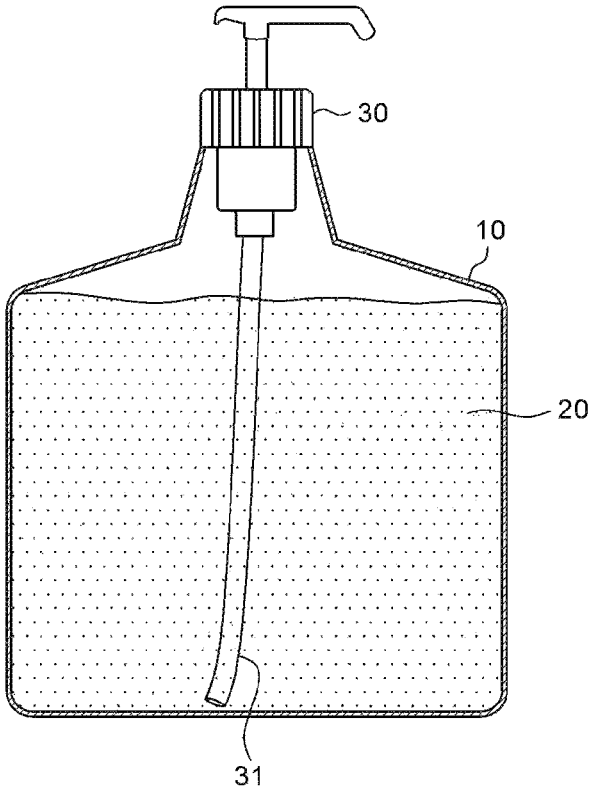
FIG. 1A is a diagram illustrating a container device for liquid content according to the related art.
Figure 1B:
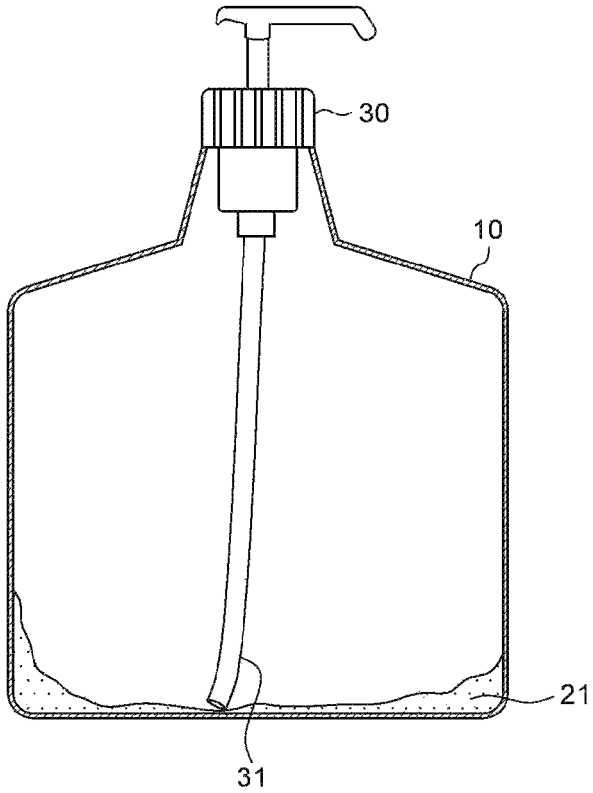
FIG. 1B is a view illustrating a container device having only a small amount of the residual content therein for the liquid content with high viscosity according to the related art.
Figure 2A:
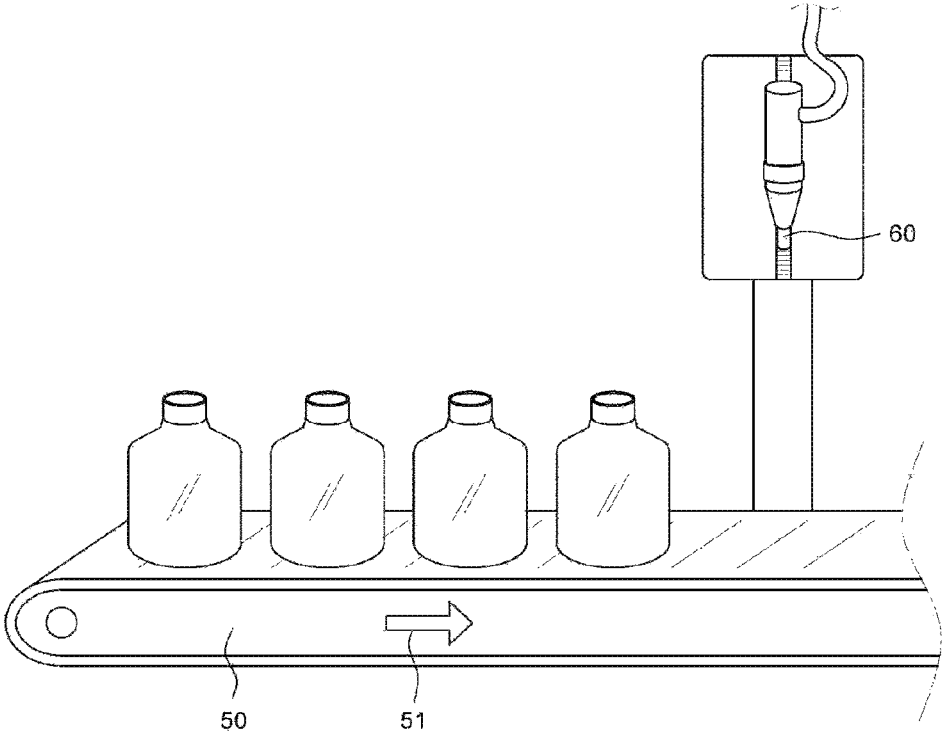
FIG. 2A is a view illustrating a typical liquid content filling method and procedure generally used in the relevant industrial field in manufacturing a liquid content product such as shampoo or lotion.
Figure 2B:
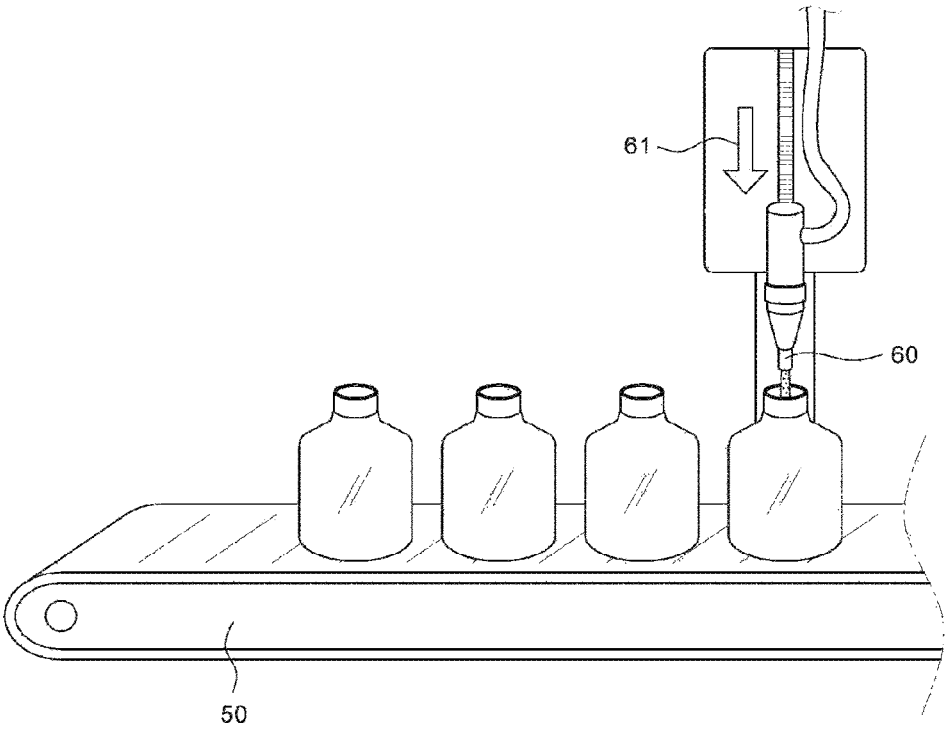
FIG. 2B is a view illustrating a typical liquid content filling method and procedure generally used in the relevant industrial field in manufacturing a liquid content product such as shampoo or lotion.

The advantages and features of the present disclosure and the method for achieving them will become apparent with reference to the embodiments, which will be described in detail below together with the accompanying drawings. However, the present disclosure is not limited to the embodiments disclosed below, but can be implemented in many different forms, and the embodiments are merely provided so that the disclosure of the present disclosure is thorough, and to fully convey the scope of the disclosure to those skilled in the art to which the present disclosure pertains, and the present disclosure is only defined by the scope of the claims.

Although the first, second, etc. are used to describe various components, it is natural that these components are not limited by these terms. These terms are used only to distinguish one component from another. Therefore, it is natural that the first component described below can also be the second component within the technical spirit of the present disclosure.

Throughout the specification, same reference numerals refer to same components.

The respective features of various embodiments of the present disclosure can be coupled or combined with each other partially or entirely, various interlocking and driving is technically possible as can be understood by those skilled in the art, and the respective embodiments can be preformed independently with respect to each other and can also be performed together in association therewith.

Meanwhile, the potential effects that can be expected by the technical features of the present disclosure, which has not been specifically described in the specification of the present disclosure, are regarded as described in the present specification, and the present embodiment is provided to explain the present disclosure for those skilled in the art more completely, such that the content illustrated in the drawings can be exaggerated compared to the actual implementation figure of the disclosure, and the detailed description of the configuration, which is determined to unnecessarily obscure the subject matter of the present disclosure is omitted or briefly described.

In the present specification, the 'liquid' refers to a wide range of liquid state rather than a solid or gaseous state. That is, it means all states that have a short intermolecular distance and low kinetic energy but are not stuck with each other as strongly as solid-phase molecules, and is used as the meaning that includes all liquids from dilute liquid such as water to the liquid with strong viscosity such as gels.

In the present specification, the 'liquid' refers to a wide range of liquid state rather than a solid or gaseous state. That is, it means all states that have a short intermolecular distance and low kinetic energy but are not stuck with each other as strongly as solid-phase molecules, and is used as the meaning that includes all liquids from dilute liquid such as water to the liquid with strong viscosity such as gels.

In the present specification, the pouch, as a flexible pouch, may mean a pouch, which does not have a predetermined shape and has the restoring force for returning to its original shape when being stretched or inflated with the elasticity while changing in shape by an external force and a pouch, as a simple flexible pouch, which does not have the predetermined shape and changes in shape by an external force.

In the present specification, the container means all kinds of containers of rigid materials having a uniform shape, such as plastic, glass, and metal, and can be used with ' rigid container'. In addition, the container performs a function of keeping the depressurized state when the in-container component such as the pouch has been expanded.

In the present specification, the coupling unit means a structure that couples with the opening of the pouch to couple with the container coupling portion of the container (the injection port (opening) of the container), thereby coupling the pouch and the container so that the pouch can be fixed in the container. The coupling unit may further include an air blocking portion so that the space between the container and the pouch can be completely blocked from the outside.

In the present specification, the container device means all types of containers having the dispenser (the discharger) such as an air pump or a nozzle to discharge the content.

In the present specification, the discharger means a structure that is coupled with the container and performs a function of discharging the liquid content stored in the pouch. The discharger can be implemented as a pump type, or can also be implemented by providing a valve for adjusting the amount of content per unit time conveyed to the discharging tube or the discharging portion when the content is automatically pushed to the discharging port by the restoring force because the pouch has the elasticity according to an embodiment of the present disclosure, and furthermore, can also be implemented as a configuration having a simple discharging port.

Hereinafter, various embodiments of the present disclosure will be described in detail with reference to the accompanying drawings.

Figure 3A:
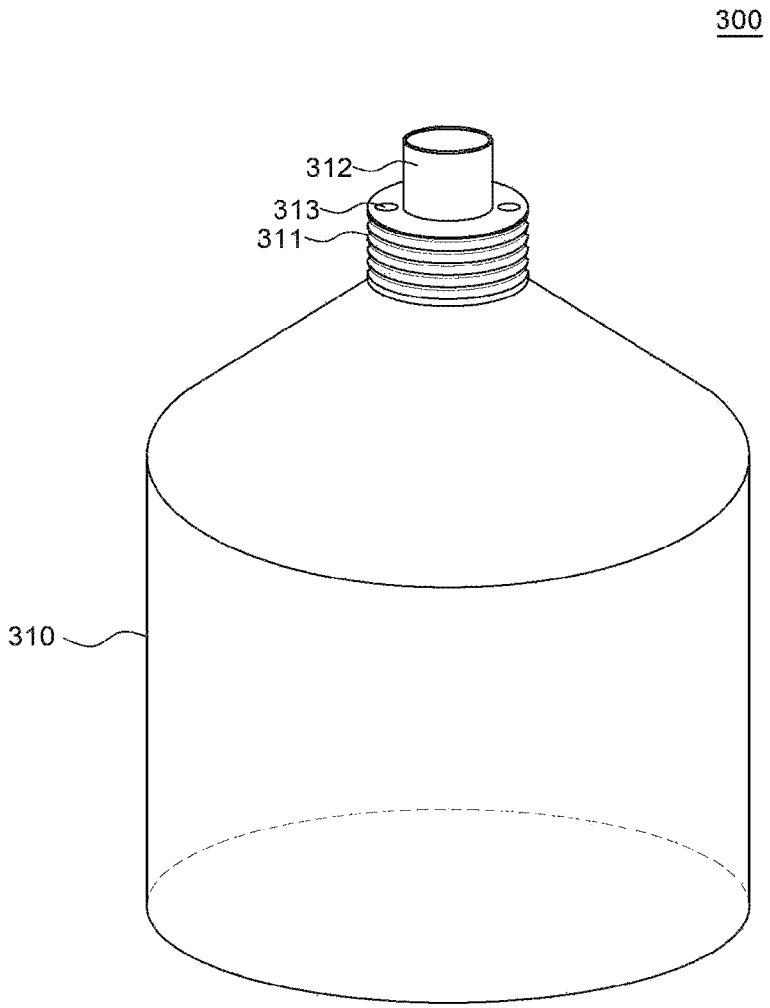
FIG. 3A is a view illustrating a container device according to an embodiment of the present disclosure.
Figure 3B:
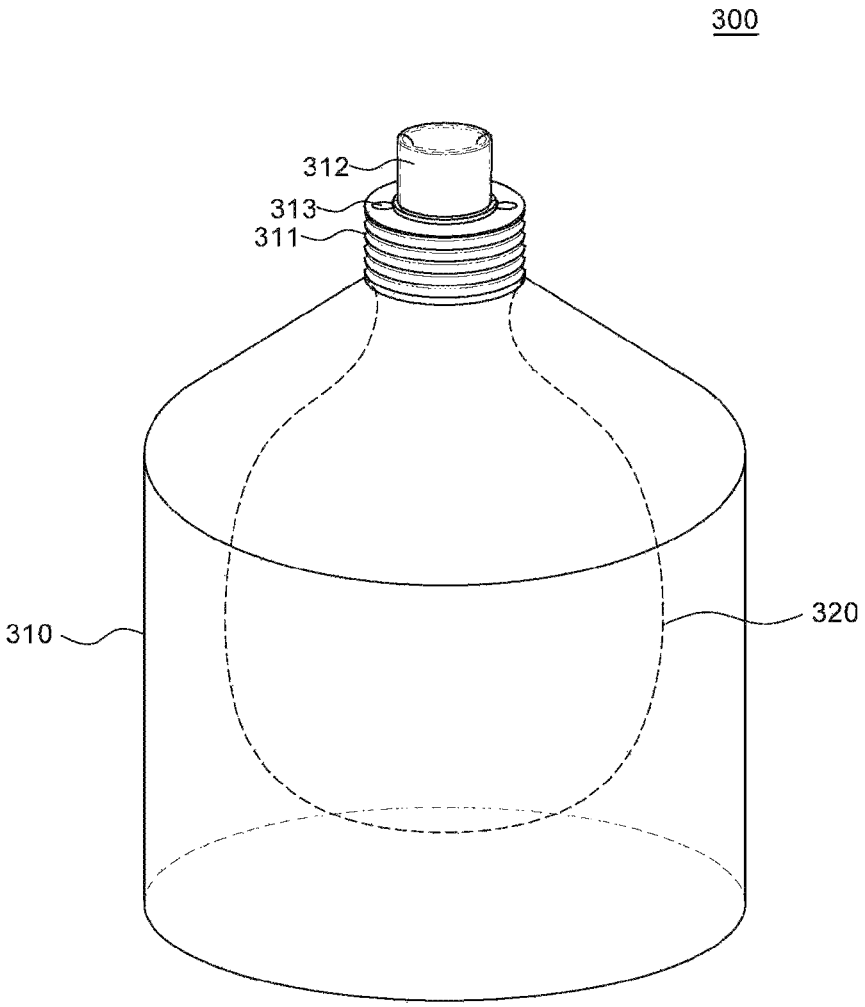
FIG. 3B is a view illustrating the container device according to an embodiment of the present disclosure.
Figure 3C:
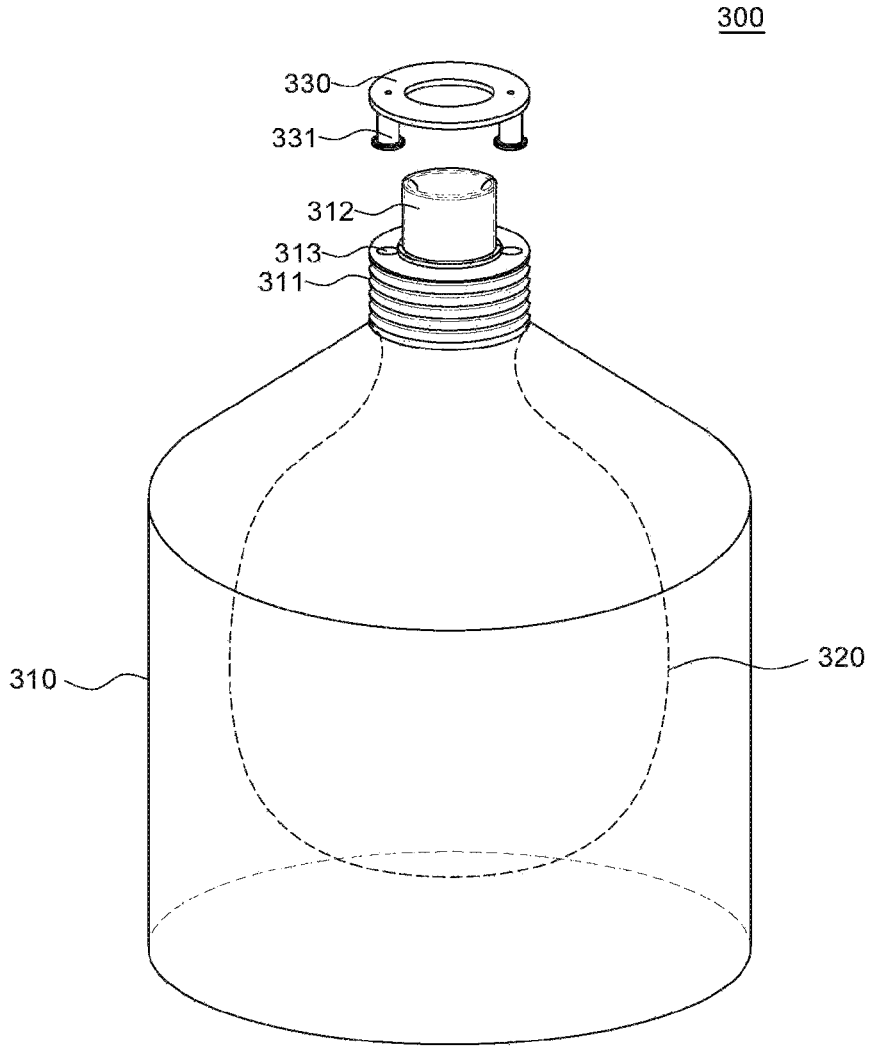
FIG. 3C is a view illustrating the container device according to an embodiment of the present disclosure.

FIGS. 3A to 3C are views illustrating a container device 300 according to an embodiment of the present disclosure. The container device 300 according to the present disclosure may include a pouch 320 in which content is stored; a container 310 in which the pouch 320 can be expanded in the container device 300; a coupling unit 330 which allows coupling of the pouch 320 to the container device 300; a container coupling portion 311 for coupling with a discharger through a coupling means such as a thread provided at an opening of the container 310; a pouch coupling portion 312 for coupling with the pouch 320; and an air discharging port 313.

The container 310 can be implemented with various materials such as plastic, glass, ceramic, and metal. The container 310, the container coupling portion 311, and the pouch coupling portion 312 are generally implemented as a single body with a same material, but can also be implemented as distinct parts, or implemented by coupling one or more components into a single structure.

For an exemplary purpose, the pouch coupling portion 312 and the air discharging port 313 may be implemented as a single structure having a single body, and the corresponding structure can also be coupled with the container coupling portion 311. When the spirit of the present disclosure is implemented as described above, the pouch coupling portion 312 can be formed to have a single configuration with the coupling unit 330, and the pouch coupling portion 312 and the coupling unit 330 can be coupled to the pouch 320 and fastened to the container 310 as a single component.

Meanwhile, although it is illustrated in FIG. 3A that the pouch coupling portion 312 protrudes upward from the container coupling portion 311 with respect to the upper end of the container coupling portion 311, this is exemplary only, and the pouch coupling portion 312 may also be formed downward from the container coupling portion 311 with respect to the upper end of the container coupling portion 311. Also, as another embodiment of the present disclosure, the container coupling portion 311 and the pouch coupling portion 312 may also be implemented to have a single configuration.

The container 310 is equipped with a space in which the pouch 320 is inserted through the opening of the container device 300 and can be expanded to store and contain the content. Through this, the pouch 320 can be expanded in the container 310 so as to conform to the shape of outer case of the container 310. Therefore, the pouch 320 can also secure a storing space capable of containing and storing the content to the extent of the volume of the container 310 using the typical filling facility.

The container coupling portion 311 may have a coupling means such as a thread so that a discharger can be coupled to the container device 300 after the pouch 320 is filled with the content. Although it is illustrated in FIG. 3A that the coupling means has a thread, the thread can be replaced with various coupling means or coupling structures capable of coupling the discharger to the container device 300.

The air discharging port 313 performs a function of discharging the air in the container 310 to the outside of the container device 300 to lower the pressure in the container 310 in order to expand the pouch 320 positioned in the container device 300. The air discharging port can be formed as a hole in the container 310, or formed as a groove therein.

Meanwhile, the air discharging port 313 can also function as a fastening means so that the coupling unit 330 can be firmly coupled with the container 310. Although it is illustrated in FIGS. 3A to 3C that two air discharging ports 313 are provided, depending on an embodiment, multiple discharging ports may be formed on the upper end plane of the container coupling portion 311 and only some of them may be used as passages for discharging air. That is, in some embodiments, a plurality of air discharging ports 313 are provided and only some thereof are used for discharging air.

As illustrated in FIG. 3B, the pouch coupling portion 312 provides a configuration in which the pouch 320 can be coupled to the container 310 so that the pouch 320 is inserted into and fixed to the container device 300. Through this configuration, the opening of the pouch 320 is coupled with the pouch coupling portion 312 and the pouch 320 is inserted into the container 310. Therefore, all the content injected into the opening of the container device 300 is filled in the pouch 320.

As illustrated in FIG. 3C, the coupling unit 330 is fastened to the pouch coupling portion 312 when the pouch 320 is coupled to the pouch coupling portion 312 of the container device 300. If the pressure in the container 310 of the container device 300 is lowered through the air discharging port 313, the pouch 320 coupled to the pouch coupling portion 312 might be taken off. Thus, the coupling unit 330 is needed to firmly couple the pouch 320 to the pouch coupling portion 312. The coupling unit 330 will be described below in detail with reference to FIGS. 4A to 4C.

Figure 4A:
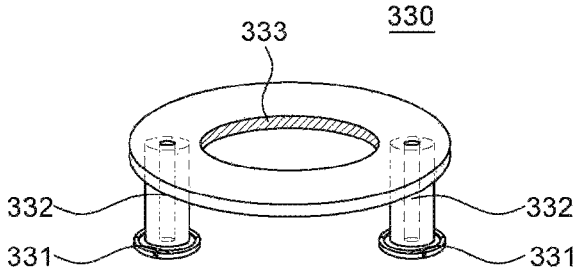
FIG. 4A is a perspective view of a coupling unit according to an embodiment of the present disclosure.
Figure 4B:
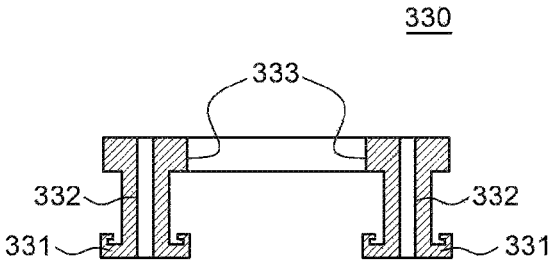
FIG. 4B is a cross-sectional view of the coupling unit according to an embodiment of the present disclosure.
Figure 4C:
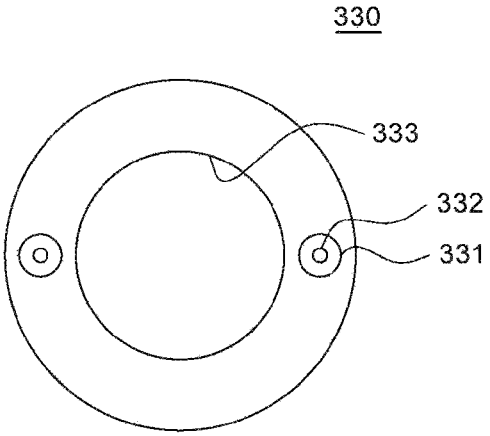
FIG. 4C is a rear view of the coupling unit according to an embodiment of the present disclosure.

FIGS. 4A to 4C are views illustrating a coupling unit according to an embodiment of the present disclosure. FIG. 4A is a perspective view of a coupling unit according to an embodiment of the present disclosure, FIG. 4B is a cross-sectional view of the coupling unit according to an embodiment of the present disclosure, and FIG. 4C is a rear view of the coupling unit according to an embodiment of the present disclosure.

The coupling unit 330 performs a function of fastening the pouch 320 to the pouch coupling portion 312 so that the pouch 320 can be firmly coupled to the pouch coupling portion 312. For this purpose, as illustrated in FIGS. 4A to 4C, the coupling unit 330 can be fitted into the outside of the pouch 320 put on the pouch coupling portion 312. At this time, as illustrated in FIGS. 4A to 4C, the coupling unit 330 may have a fastening ring 333 for firmly fixing the pouch 320 to the pouch coupling portion 312. The fastening ring 333 may firmly couple the pouch 320 to the pouch coupling portion 312 by applying the vertical pressure to the pouch 320 and the pouch coupling portion 312 by the contracting force of the coupling unit 330.

Meanwhile, the coupling unit 330 may include a fixing portion 331 for fixing it to the container 310, which constitutes the body of the container device 300, in order to firmly couple the pouch 320 to the pouch coupling portion 312. As illustrated in FIG. 3C, the fixing portion 331 can firmly couple the coupling unit 330 with the container 310 by fastening a protrusion portion formed with a protrusion to the air discharging port 313 of the container 310 similar to a button. However, the fixing portion 331 can also be implemented in a different manner from the protrusion portion, and may also be implemented to be coupled with the rigid container through an adhesive agent, etc., for example.

Meanwhile, the fixing portion 331 may include an air discharging tube 332 to discharge the air in the container 310 to the outside of the container device 300 through the air discharging port 313. In such case, if two or more fixing portions 331 are provided, the air discharging tubes 332 may be formed only at some of the fixing portions 331, or, the air discharging tubes 332 may be formed at all the fixing portions 331.

Figure 5A:
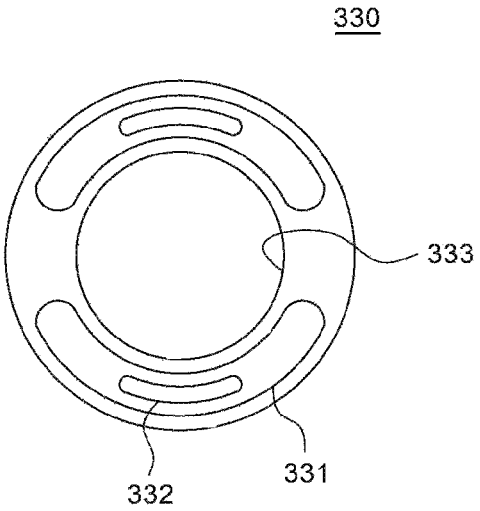
FIG. 5A is a view illustrating a coupling unit according to another embodiment of the present disclosure.
Figure 5B:
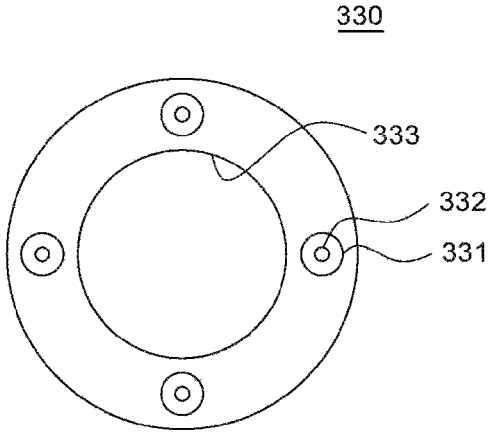
FIG. 5B is a view illustrating the coupling unit according to another embodiment of the present disclosure.

FIGS. 5A and 5B are views illustrating a coupling unit according to another embodiment of the present disclosure.

As illustrated in FIGS. 5A and 5B, the fixing portion 331 provided at the coupling unit 330 can be implemented to have various shapes. As in FIG. 5A, the fixing portion 331 may be implemented to form the protrusion portion which is equipped with the projection along the edge of the coupling unit 330. In this case, it is possible to couple the coupling unit 330 to the rigid container more firmly. Furthermore, as illustrated in FIG. 5B, four circular fixing portions 331 may be formed. As illustrated in FIGS. 5A and 5B, when each of the fixing portions 331 are formed, it is possible to design the air discharging port 313 of the container or the negative groove or hole to correspond thereto so that the fixing portion 331 can be fastened to the rigid container, and the air discharging tube 332 may be formed on a region where the air discharging port 313 is formed.

As the fundamental feature and the requirement of the coupling unit 330, the coupling unit 330 should satisfy the requirement that the pouch 320 be inserted through the opening of the container 310 to completely block the space between the pouch 320 inserted into the container 310 and the container 310 from the outside of the container 310 although the container 310 and the pouch 320 are inevitably made of different materials. It should be understood that the spirit of the present disclosure covers any equivalent structures so long as the aforementioned requirement is satisfied.

Figure 6A:
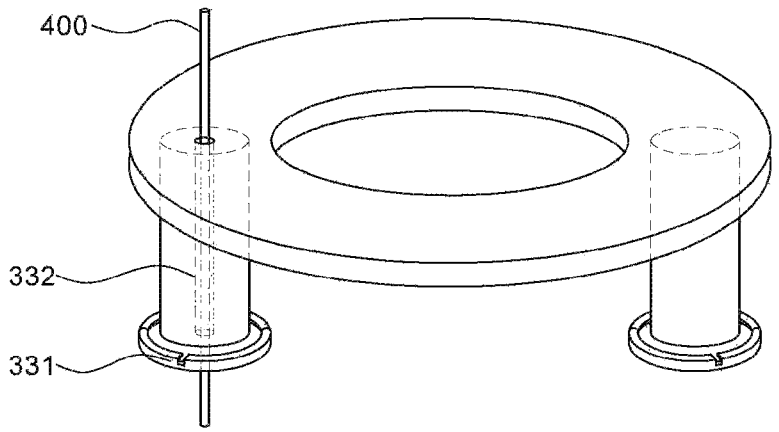
FIG. 6A is a view illustrating a coupling unit according to an embodiment of the present disclosure.
Figure 6B:
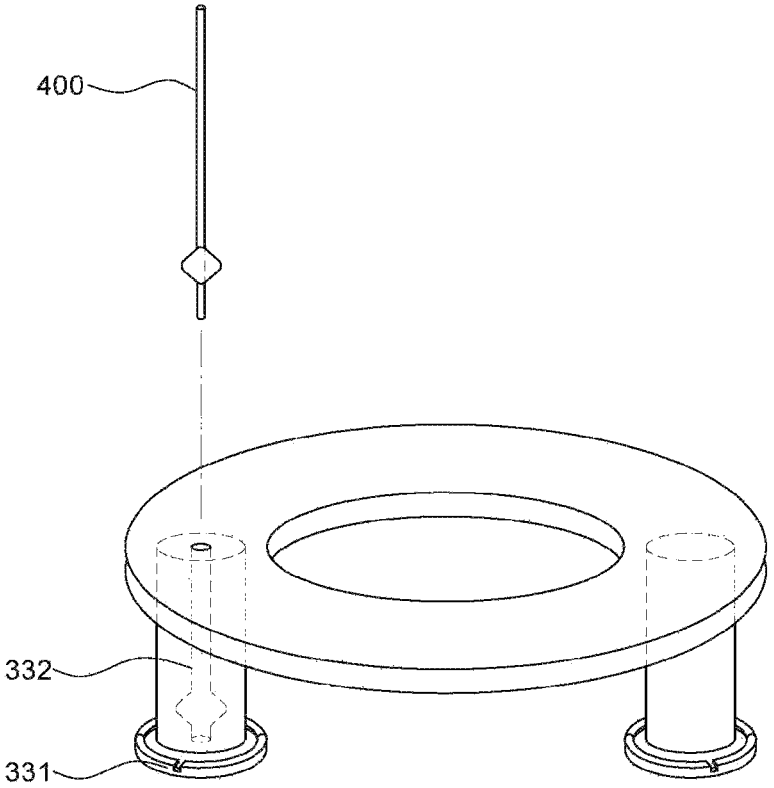
FIG. 6B is a view illustrating the coupling unit according to an embodiment of the present disclosure.

FIGS. 6A and 6B are diagrams illustrating a coupling unit according to an embodiment of the present disclosure.

According to FIG. 6A, an air discharging pin 400 can pass through the air discharging tube 332 of the coupling unit 330 to discharge the air in the container 310 to the outside of the container 310 through the air discharging port 313 of the container device 300. The air discharging tube 332 is a structure such as a valve and may be implemented to have a configuration such that it is opened when the air discharging pin 400 is inserted into the air discharging tube 332 and is closed when the air discharging pin 400 is removed from the air discharging tube 332.

Furthermore, the air discharging tube 332 may further include a check valve according to an embodiment of the present disclosure. The check valve may allow liquid or gas to flow only in one direction, and the check valve can be provided at one end of the air discharging tube 332. The check valve is typically formed at the opposite side of the air discharging tube 332 from which the air discharging pin 400 is inserted. The check valve may be implemented as a same material as the coupling unit 330, or formed to have a separate configuration and be coupled to the coupling unit 330. When the check valve is applied to the air discharging tube 332, the air can flow only in one direction, thereby discharging the air to the outside of the container 310 while preventing the air from flowing into the container 310.

As illustrated in FIG. 6B, the air in the space between the pouch 320 and the container 310 is discharged to the outside of the container device 300 through the air discharging pin 400. As the air in the space between the pouch 320 and the container 310 is reduced, the pressure at the corresponding region is lowered to inflate the pouch 320.

Figure 7:
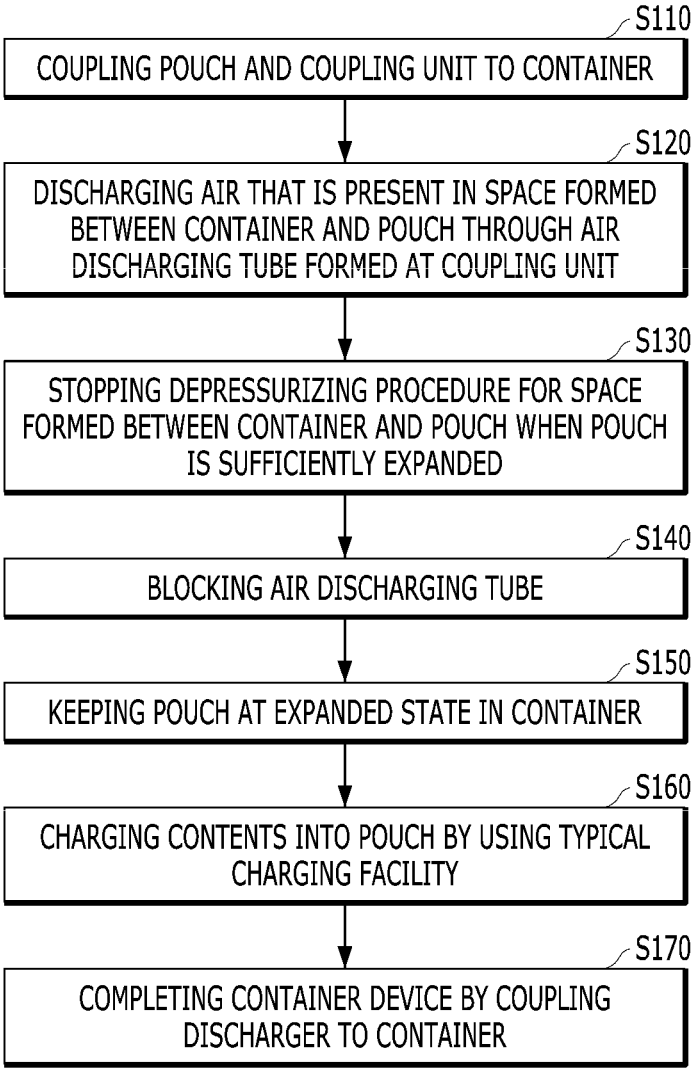
FIG. 7 is a flowchart illustrating a container device manufacturing method according to an embodiment of the present disclosure.

FIG. 7 is a flowchart illustrating a container device manufacturing method according to an embodiment of the present disclosure.

According to FIG. 7, at step S110, the pouch 320 and the coupling unit 330 are first coupled to the container 310 in order to manufacture the container device 300. At this time, according to an embodiment of the present disclosure, although it has been described that the pouch 320 is first coupled to the pouch coupling portion 312 of the container 310 and then the coupling unit 330 is fastened to the outside of the pouch 320 to couple the pouch 320 to the container 310, this is simply an example for achieving the object that the pouch 320 and the container 310 should be coupled to the opening of the container 310 in a sealed state although they are a separate configuration, respectively. Thus, it should be understood that it is within the scope of the present disclosure so long as the coupling unit 330 performs its function as the object for coupling the container 310 and the pouch 320 even when the coupling unit 330 is designed to have a different structure or the coupling unit 330 is first coupled to the container 310 and then the pouch 320 is coupled thereto.

When the coupling unit 330 is fastened to the container 310 and the space between the pouch 320 in the container 310 and the container 310 is sealed, the air discharging pin 400 is inserted to discharge the air through the air discharging tube 332 formed at the coupling unit 330 and the air discharging port 313 formed at the container 310. At this time, as the air is discharged, the pressure in the container 310 is lowered and the pouch 320 is expanded S120.

When the pouch 320 is sufficiently expanded, or the air in the container 310 is discharged by a predetermined volume, the depressurizing procedure of the space between the pouch 320 and the container 310 is terminated S130, and the air discharging tube 332 is blocked S140. An additional structure such as a cap may be coupled to the air discharging tube 332 to block the air discharging tube 332. The air inflow into the container 310 is restricted even without a separate blocking action in case the air discharging tube 332 is configured to move the air only in one direction such as the check valve, or, in case the air can flow into and out only when the air discharging pin 400 is inserted into the air discharging tube 332.

When the pouch 320 is sufficiently expanded in the container 310 and the air discharging pin 400 is removed, the pouch 320 is kept in the expanded state S150, thereby easily filling the liquid content into the container device 300 by using the typical content filling equipment S160, and the container or the container device can be implemented by coupling the discharger S170.

Figure 8A:
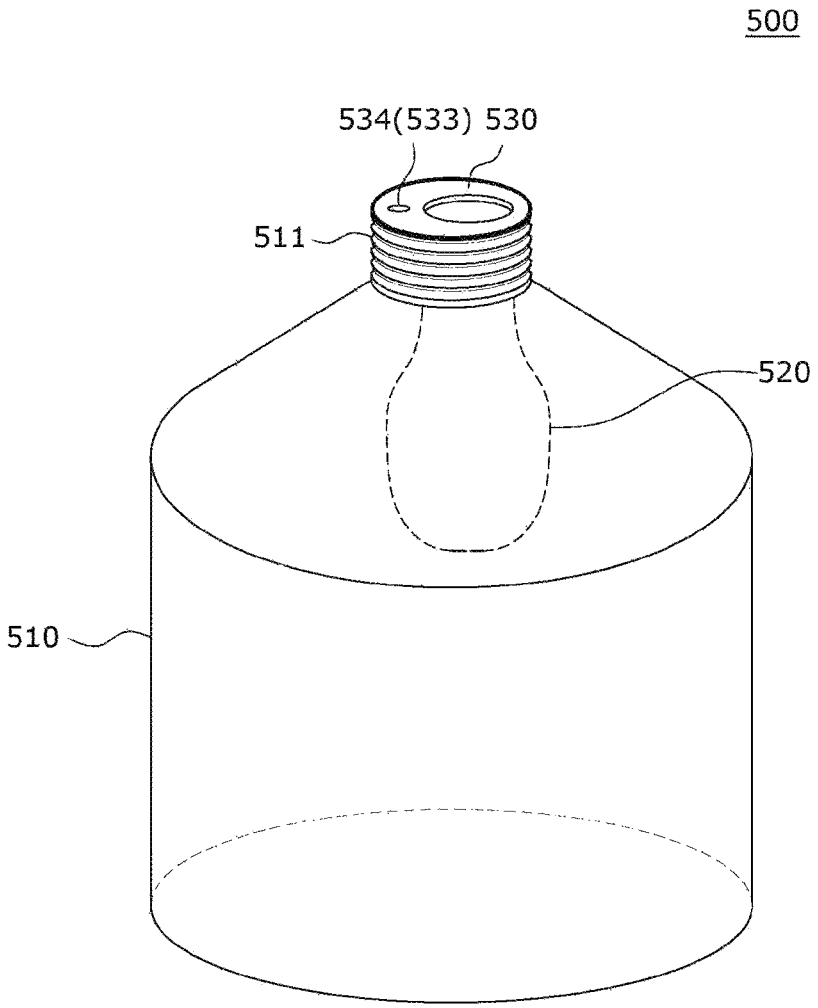
FIGS. 8A to 8C are views illustrating a container device 500 according to an embodiment of the present disclosure.
Figure 8B:
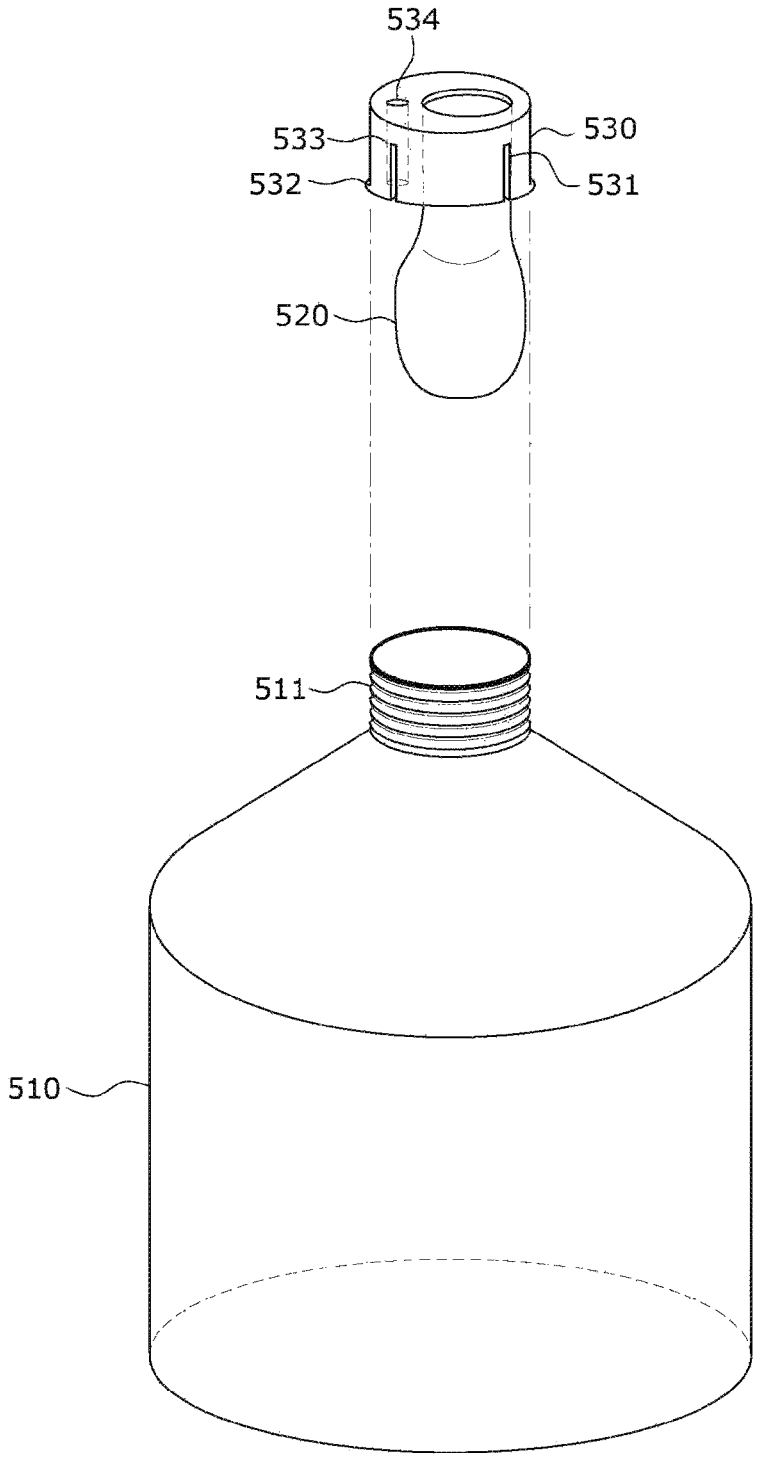
Figure 8C:
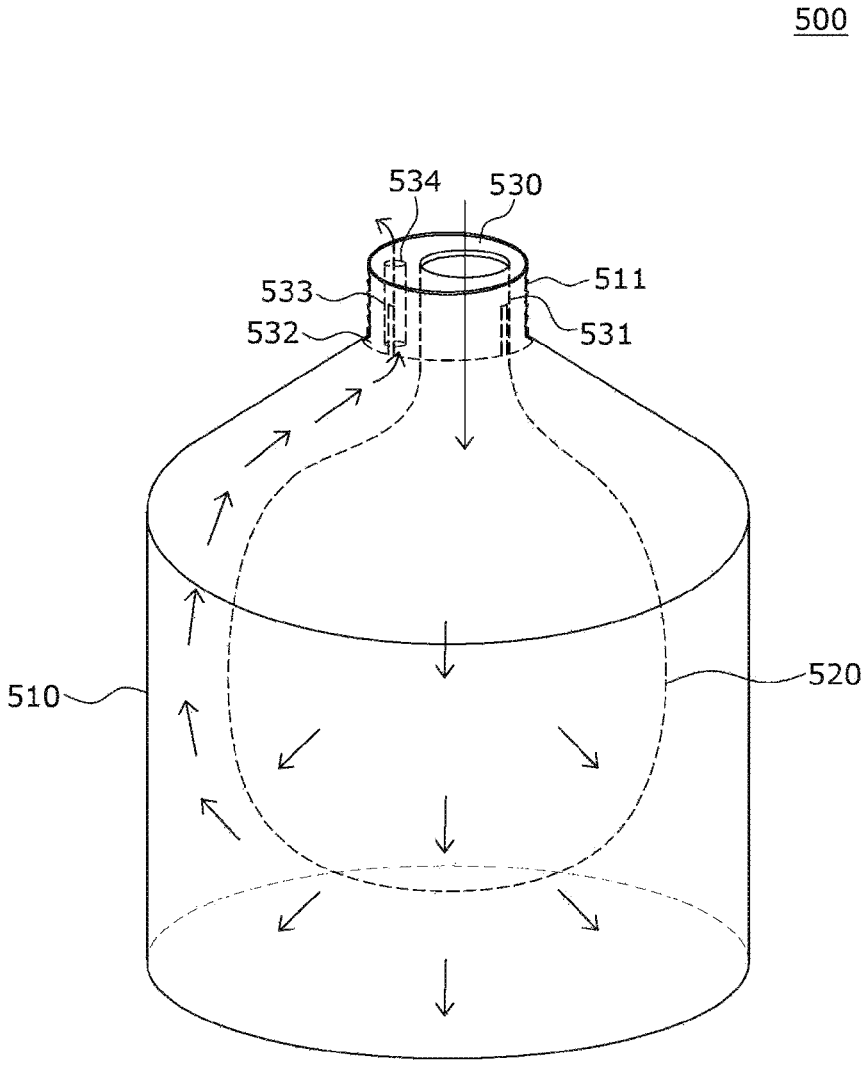

FIGS. 8A to 8C are views illustrating a container device 500 according to an embodiment of the present disclosure. The container device 500 according to the present disclosure may include a pouch 520 in which content is filled, a container 510 in which the pouch 520 can be expanded in the container device 500, a coupling unit 530 for coupling the pouch 520 to the container device 500, and a container coupling portion 511 for coupling a discharger to an opening of the container 510 through a coupling means such as a thread.

The coupling unit 530 may include a pouch fastening portion 531, a fixing portion 532, an air discharging tube 533, and an air blocking portion 534.

The container 510 may be implemented with various materials such as plastic, glass, ceramic, and metal. The container 510 and the container coupling portion 511 are generally implemented with a single body as a same material, but may also be implemented as distinct parts, or implemented by coupling one or more components as a single structure.

The container 510 is provided with a space in which the pouch 520 inserted through the opening of the container device 500 may be expanded to store and contain the content therein. Therefore, the pouch 520 can be expanded according to the outer case of the container 510. Therefore, the pouch 520 can also secure a storing space capable of containing and storing the content by the volume of the container 510 using a typical filling facility.

The container coupling portion 511 may have a coupling means such as a thread so that the pouch 520 is filled with the content and then the discharger may be coupled to the container device 500. Although it has been illustrated in FIG. 8A that the coupling means has the thread, the thread can be replaced with various coupling means or coupling structures that can couple the discharger to the container device 500.

Meanwhile, the container coupling portion 511 can be formed to have a single structure with the coupling unit 530 according to an embodiment of the present disclosure. In this case, the container coupling portion 511 is a component distinct from the container 510, and can perform both the function of the coupling unit 530 for coupling with the discharger and the function of coupling the pouch 520 with the container 510 so as to facilitate coupling with the container 510.

As illustrated in FIG. 8B, the coupling unit 530 performs a function of coupling the pouch 520 to the container device 500 so that the pouch 520 can be inserted into and fixed to the container 510. The opening of the pouch 520 is coupled with the coupling unit 530, and the coupling unit 530 is coupled to the inside of the opening of the container 510. Therefore, when the content is injected into the opening of the container device 500, all the content is filled in the pouch 520. However, according to an embodiment of the present disclosure, the coupling unit 530 may also be coupled with the container coupling portion 511 and as described above, the coupling unit 530 itself can operate as the container coupling portion 511.

As illustrated in FIG. 8C, when the pouch 520 is coupled to the container 510 through the coupling unit 530, the space between the container 510 and the pouch 520 in the container device 500 is sealed, and the air discharging tube 533 (the air discharging port) may be the only air passage to the outside of the container 510. That is, the air discharging tube 533 allows the air in the space between the internal wall of the container 510 and the pouch 520 to be discharged to the outside. Therefore, when the air in the container 510 is discharged through the air discharging tube 533 and the pressure in the container 510 of the container device 500 is lowered, the pouch 520 might be taken off from the coupling unit 530. Thus, the coupling unit 530 should have a structure that can firmly hold the pouch 520 and completely block the space between the container 510 and the pouch 520 from the outside. The coupling unit 530 will be described below in detail with reference to FIGS. 9A to 9C.

Figure 9A:
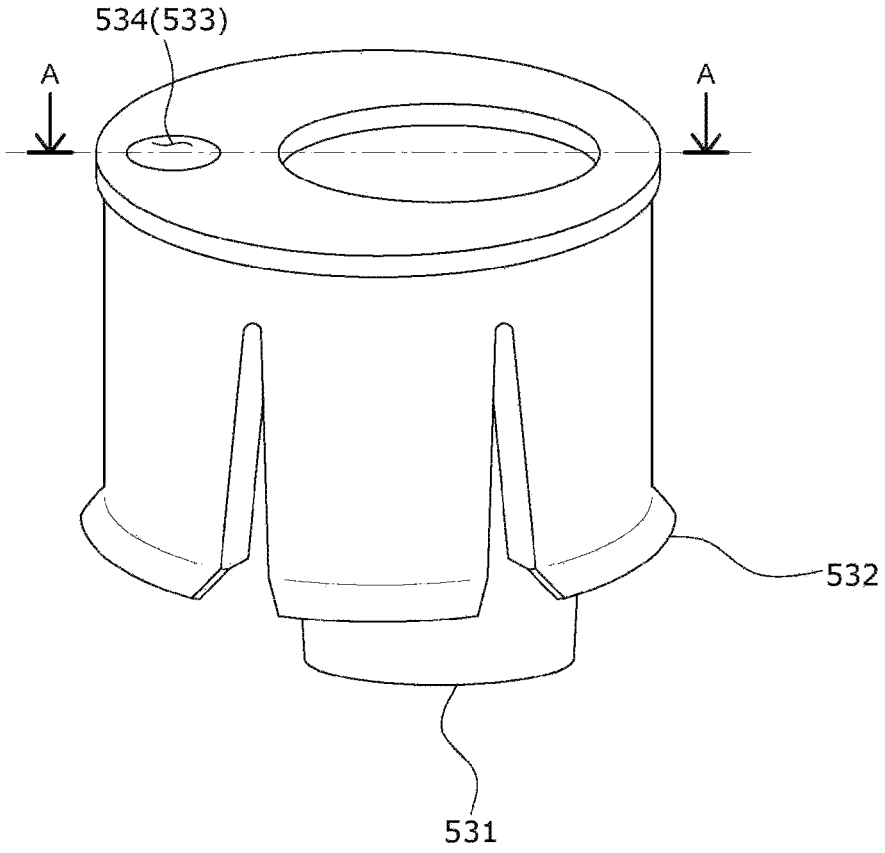
FIG. 9A is a perspective view of a coupling unit according to an embodiment of the present disclosure.
Figure 9B:
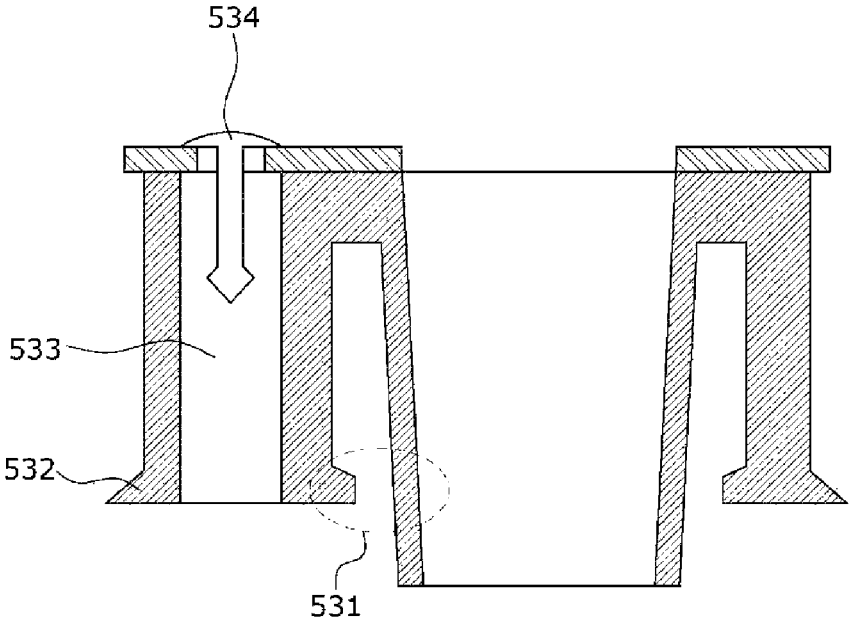
FIG. 9B is a cross-sectional view of the coupling unit according to an embodiment of the present disclosure.
Figure 9C:
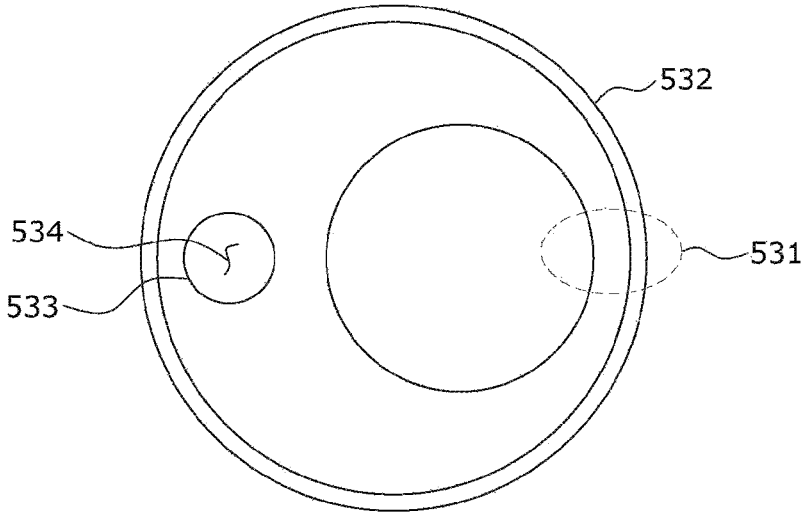
FIG. 9C is a rear view of the coupling unit according to an embodiment of the present disclosure.

FIGS. 9A to 9C are views illustrating a coupling unit according to an embodiment of the present disclosure. FIG. 9A is a perspective view of a coupling unit according to an embodiment of the present disclosure, FIG. 9B is a cross-sectional view of the coupling unit according to an embodiment of the present disclosure, and FIG. 9C is a rear view of the coupling unit according to an embodiment of the present disclosure.

The coupling unit 530 can perform a function of holding so that the pouch 520 can be fixed to the container 510 while firmly fastening the container 510 and the pouch 520 when the pouch 520 is coupled to the container 510. For this purpose, as illustrated in FIGS. 9A to 9C, the coupling unit 530 can be fastened to the pouch 520 to be fitted into the container coupling portion 511 of the container 510. At this time, as illustrated in FIGS. 9A to 9C, the coupling unit 530 can have a pouch fastening portion 531 which prohibits the pouch 520 from being separated from the coupling unit 530. The pouch fastening portion 531 can seal the space between the pouch 520 and the container 510 when the air discharging tube 533 is closed by coupling the pouch 520 with the internal wall of the container coupling portion 511 that is the opening of the container 510 while coupling the pouch 520 with the main body of the coupling unit 530. The pouch fastening portion 531 couples the pouch 520 with the internal wall of the container coupling portion 511 while coupling the pouch 520 to the coupling unit 530 to seal the space between the pouch 520 and the container 510, thereby suppressing the pouch 520 inflated in the container 510 from being contracted.

The coupling unit 530 may further include a fixing portion 532 for firmly coupling the pouch 520 to the inside of the container coupling portion 511 of the container 510 while fastening the pouch 520. As illustrated in FIGS. 9A to 9C, the fixing portion 532 may be implemented as a hook formed with a protrusion to couple the coupling unit 530 with the container 510 inside the container 510. However, the fixing portion 532 can also be implemented to have different structures other than the hook. For example, the fixing portion 532 may be implemented as an adhesive agent applied to the exterior wall of the coupling unit 530, or, also implemented to have a structure or a pattern capable of increasing the friction force between the exterior wall of the coupling unit 530 and the internal wall of the container 510.

The coupling unit 530 may include the air discharging tube 533 so that the air in the container 510 can be discharged to the outside of the container device 500. The air discharging tube 533 performs a function of discharging the air between the container 510 and the pouch 520 inserted into the container 510 to the outside of the container device 500, and in addition, also performs a function of reducing the size of the pouch 520 when the content is discharged by allowing the outside air to flow into the container 510 at the time of using the container device 500.

The air blocking portion 534 can be provided at one end of the air discharging tube 533 or therein. The air blocking portion 534 can prevent the outside air from flowing back into the container 510 and helping keeping the expanded state of the pouch 520 even when the gas injection into the pouch 520 is stopped when the air in the container 510 is discharged to the outside through the air discharging tube 533 as the pouch 520 is expanded. The air blocking portion 534 can be implemented to have an air blocking valve having directionality such as the check valve according to an embodiment of the present disclosure. That is, the air blocking portion 534 can be a valve means for allowing air to flow only in one direction from the inside of the container 510 toward the outside of the container 510. At this time, one side of the air blocking portion 534 contacts the inside of the container 510, and the other side of the air blocking portion 534 contacts the atmosphere.

The air discharging tube 533 can be used as an air inflow passage in order to facilitate the contraction of the pouch 520 according to the consumption of the content when the content is charged into the pouch 520 and the container device 500 is used. The air blocking portion 534 can be inactivated if the air discharging tube 533 is used as the air inflow passage.

Further, the air discharging tube 533 can also be formed in the container 510 according to an embodiment of the present disclosure, and the air inflow passage for contracting the pouch 520 according to the consumption can also be implemented to have the same configuration as the air discharging tube 533 formed at the container 510, and also formed to have a different configuration.

Meanwhile, in understanding and construing the spirit of the disclosure of the coupling unit 530, the coupling unit 530 should satisfy the requirement that the pouch 520 should be inserted through the opening of the container 510 to completely block the space between the pouch 520 inserted into the container 510 and the container 510 from the outside of the container 510 although the container 510 and the pouch 520 are inevitably made of different materials. Also, it should be construed to be covered by the spirit of the present disclosure as long as the above-described requirement is satisfied even though it has been designed differently from the coupling unit 530 illustrated in FIGS. 9A to 9C.

Figure 10:
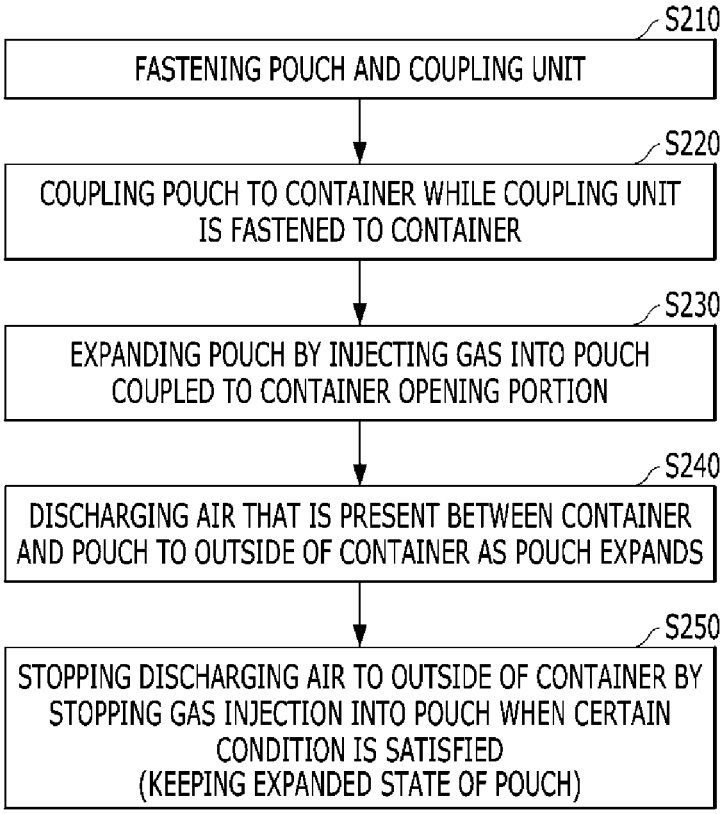
FIG. 10 is a view illustrating a container device manufacturing procedure through the air discharging according to an embodiment of the present disclosure.

FIG. 10 is a flowchart illustrating a container device manufacturing procedure through air discharging according to an embodiment of the present disclosure.

According to FIG. 10, in manufacturing the container device 500, the pouch 520 is first coupled to the coupling unit 530 S210.

When the pouch 520 and the coupling unit 530 are coupled, the pouch 520 is inserted into the container 510 through the opening of the container 510, and the coupling unit 530 is coupled with the container 510 while holding the pouch 520 S220.

Meanwhile, according to FIGS. 8A to 8C, although it has been illustrated that the pouch 520 is coupled to the coupling unit 530 before being inserted into the container 510, and then inserted into the container 510, the pouch 520 can be first coupled to the container 510 and then the coupling unit 530 can also be coupled to the pouch 520 and the container 510 depending on a structure of the coupling unit 530.

When the coupling unit 530 is coupled to the container 510, the space between the pouch 520 positioned in the container 510 and the inside of the container 510 is blocked from the outside except for the air discharging tube 533 formed at the coupling unit 530. In this state, gas or liquid is injected into the pouch 520 through the opening of the container 510 to expand the pouch 520 S230.

When the pouch is inflated, the pressure of the internal space of the pouch 520 is equal to the atmospheric pressure, and is smaller than the restoring force of the pouch 520.

The air in the space between the pouch 520 and the inside of the container 510 is discharged to the outside of the container 510 through the air discharging tube 533 as the pouch 520 is expanded S240. When the pouch 520 is sufficiently expanded to the extent to fill the space in the container 510, the gas or liquid injection into the pouch 520 is stopped to terminate the air discharging in the container 510 S250.

As a method for stopping the gas or liquid injection into the pouch 520, one may consider either a method of stopping the expansion of the pouch 520 by terminating the gas or liquid injection when the gas or liquid is injected into the pouch 520 by the corresponding amount by setting the gas injection amount to a predetermined certain amount, or a method of stopping the gas or liquid injection by sensing the gas or liquid injection pressure or opening the gas or liquid injection port when the pouch 520 has been expanded by the volume of the container 510 and it is hard to inject more gas or liquid, etc.

The air blocking portion 534 operates when the air discharging is terminated through the air discharging tube 533 to prevent the outside air from flowing into the container 510, such that the space between the pouch 520 and the inside of the container 510 is sealed to keep the expanded state of the pouch 520 S250. Therefore, in the state, the pouch 520 can be kept in the expanded state, thereby easily filling the liquid content into the container device 500 by using a typical content filling equipment. That is, a force $P_1$ operating on the inner surface of the pouch 520 by the pressure of the internal space of the pouch 520, and a force $P_2$ operating on the outer surface of the pouch 520 by the pressure of the space between the pouch 520 and the rigid container 510 can be in equilibrium with the restoring force of the pouch 520, thereby keeping the expanded state of the pouch 520.

At this time, the air pressure in the space formed between the pouch 520 and the container 510 is kept such that, while the expanded state of the pouch 520 is maintained, the opening of the pouch 520 is kept open to the outside through the coupling unit. Therefore, it is possible to easily fill the liquid into the pouch 520 using typical liquid filling equipment. At this time, the opening of the pouch 520 is open to the outside through the coupling unit 530.

Figure 11A:
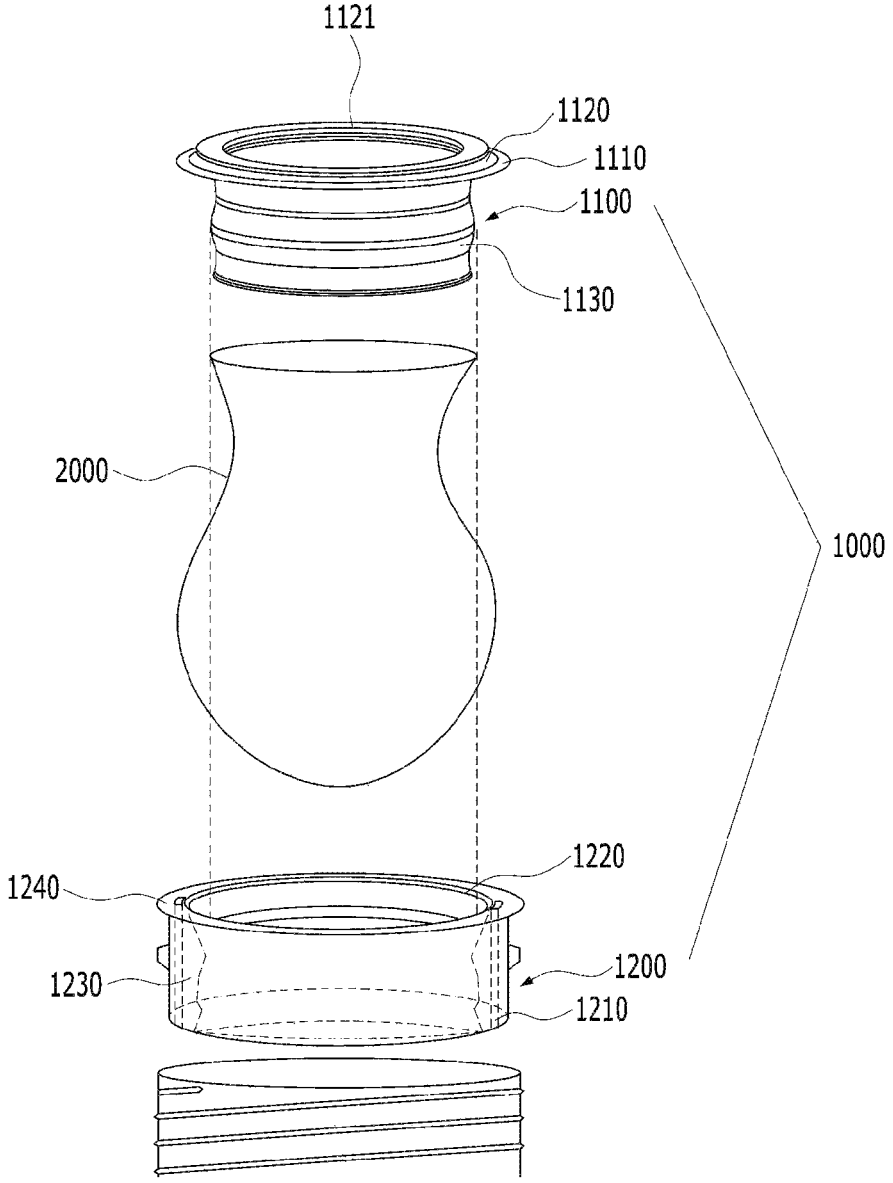
FIGS. 11A and 11B are views illustrating a coupling unit according to an embodiment of the present disclosure.
Figure 11B:
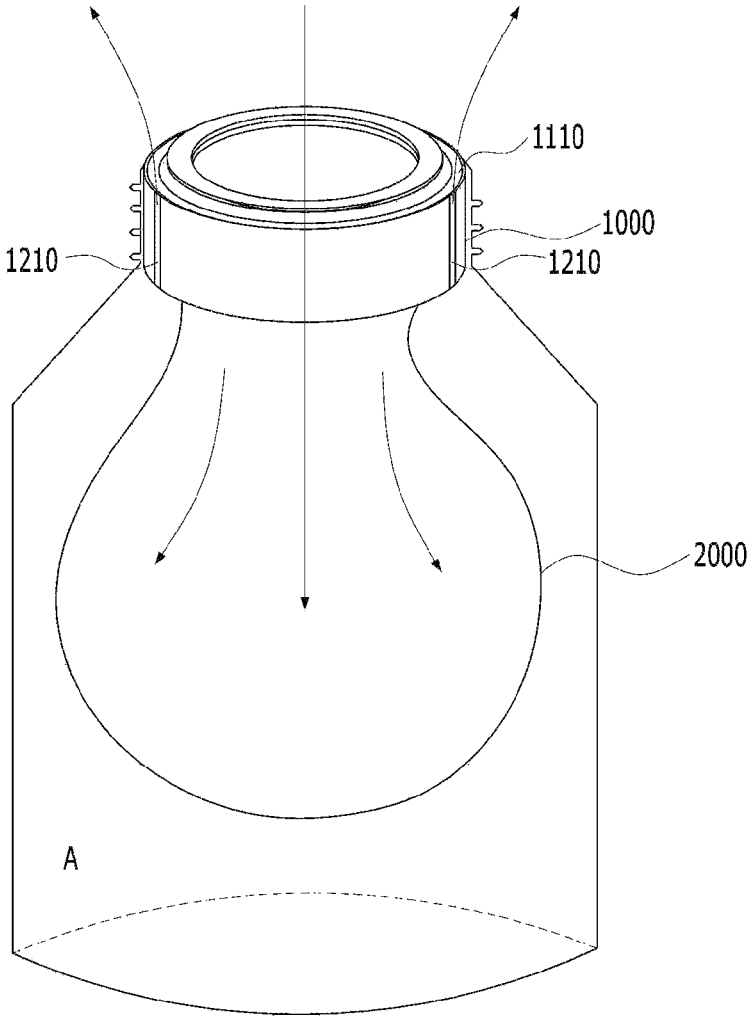

FIGS. 11A and 11B are views illustrating a coupling unit according to an embodiment of the present disclosure.

According to FIG. 11A, a coupling unit 1000 may include an upper unit 1100 and a lower unit 1200. The upper unit 1100 may include a valve portion 1110, an upper unit body 1120, and an upper unit fastening portion 1130, and the upper unit body 1120 may further include an upper unit opening 1121. The lower unit 1200 may further include an air passage 1210, a lower unit opening 1220, a lower unit fastening portion 1230, and a anti-slip prevention portion 1240.

As illustrated in FIG. 11A, the coupling unit 1000 can put a pouch 2000 on the upper unit 1100 and couple the lower unit 1200 thereon to be coupled with the pouch 2000.

Meanwhile, the outside of the lower unit 1200 can be fastened to the inside of the opening of the container to facilitate coupling with the container, and according to such a structural feature, the pouch 2000 can be inserted into the container while being fastened to the coupling unit 1000.

As illustrated in FIG. 11B, the pouch 2000 is coupled with the coupling unit 1000 and inserted into the container. When the pressure is applied to the inside of the pouch 2000, the pouch 2000 is inflated, and therefore, the air in space A between the container and the pouch 2000 is discharged to the outside of the container through the air passage 1210 by the inflating pressure of the pouch 2000. Meanwhile, the valve portion 1110 can control the air to flow into and out the container. When the expansion of the pouch 2000 is stopped and the movement of the air through the air passage 1210 is stopped, the valve portion 1110 is closed. Therefore, the air inflow into the container is blocked and the depressurized state in the container can be kept, thereby keeping the inflated state of the pouch 2000.

More detailed structural features and functions of the upper unit 1100 and the lower unit 1200 are described below with reference to FIGS. 12A to 16.

Figure 12A:
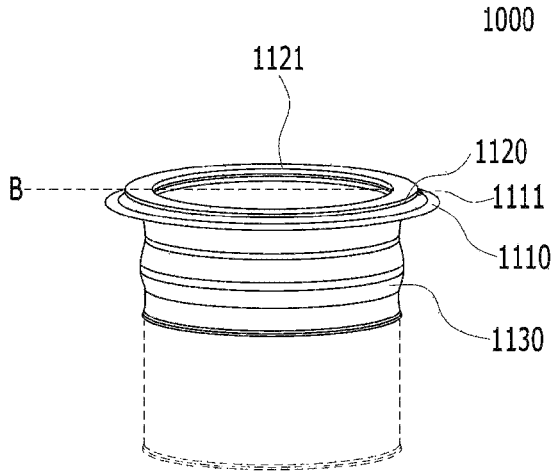
FIGS. 12A and 12B are views illustrating an upper unit of the coupling unit according to an embodiment of the present disclosure.
Figure 12B:
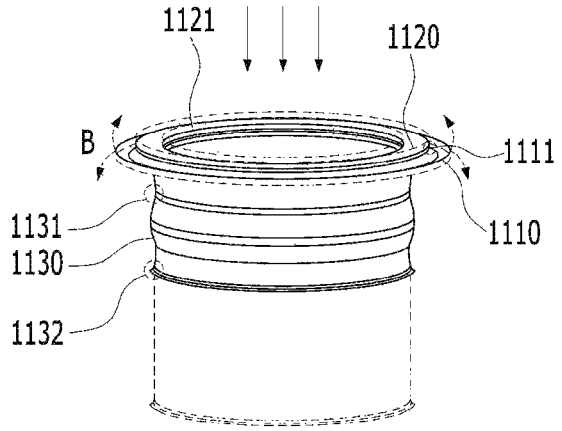

FIGS. 12A and 12B are views illustrating the upper unit of the coupling unit according to an embodiment of the present disclosure.

According to FIG. 12A, the upper unit 1100 may include the valve portion 1110, the upper unit body 1120, and the upper unit fastening portion 1130. The valve portion 1110 may further include a valve portion side connecting portion 1111. The upper unit body 1120 may further include the upper unit opening 1121. At this time, the respective structures 1110, 1120, 1130 may be made of a same material, and each of which can be coupled to each other as separate components to constitute the upper unit 1100.

The valve portion 1110 controls the air flowing into and out the container through the air passage 1210 of the lower unit 1200. For example, the valve portion 1110 can be made of an elastic material such as silicone, rubber, or synthetic material thereof. More specifically, the valve portion 1110 performs a function of the check valve for preventing the air from flowing back into the container after the air in the container is discharged to the outside of the container when the pouch 2000 is expanded for filling the content into the container. Specifically, the valve portion 1110 performs a function of an check valve having a shape of an umbrella relatively thinner than the upper unit body 1120 of the upper unit 1100.

As illustrated in FIG. 12B, due to such a structural feature, when the air is discharged from the air passage 1210 of the lower unit 1200 to the outside of the container, the valve portion 1110 is slightly lifted by the discharging pressure to discharge the air in the container to the outside. When the air discharging is completed and the discharging pressure is lowered, the valve portion 1110 having the shape of the umbrella check valve can be again adsorbed to the inlet of the air passage 1210 of the lower unit 1200, thereby preventing the air from flowing into the container. That is, when the pressure at the air passage 1210 side is smaller than the outside pressure of the valve portion 1110 with the valve portion 1110 covering the air passage 1210 interposed therebetween, the valve portion 1110 continuously covers the air passage 1210, that is, the state of closing the air passage 1210. On the contrary, when the pressure of the air passage 1210 side is larger than the outside pressure of the valve portion 1110, the end portion of the valve portion 1110 is deformed in the opposite direction of the air passage 1210, that is, upward so that the valve portion 1110 opens the air passage 1210.

The valve portion 1110 may also be implemented to have a circular shape that fully surrounds the upper unit body 1120, and also formed only on a position where the air passage 1210 is formed. At this time, the upper unit body 1120 and the valve portion 1110 may be formed integrally of an elastic material such as silicone or rubber.

The valve portion 1110 is formed to extend in the outside direction of the upper unit body 1120 at a point connected with the upper unit body 1120.

The valve portion 1110 may be configured such that the thickness may be continuously reduced from one side connected with the upper unit body 1120 toward the end portion side of the valve portion 1110 opposite to the one side thereof. For example, the lower surface of the valve portion 1110 can be formed to have a planar shape or a shape inclined downward toward the end portion side thereof, and the upper surface of the valve portion 1110 can be formed to have a shape inclined downward toward the end portion side thereof.

Meanwhile, although it has been described in the present embodiment that the cross-sectional thickness of the valve portion 1110 has a shape that is continuously reduced from one side thereof toward the end portion side thereof, a configuration, in which the cross-sectional thickness of the valve portion 1110 is gradually reduced from the one side thereof toward the end portion side thereof, that is, in which the valve portion 1110 is formed to have a stepped shape, or a configuration, in which the cross-sectional thickness of the valve portion 1110 is constantly formed from the one side thereof to the end portion side thereof, that is, in which the cross-sectional thickness thereof is the same, is also within an embodiment of the present disclosure.

In addition, although it has been described in the present embodiment that the valve portion 1110 and the upper unit body 1120 are made of a same material, the upper unit body 1120 may also be formed at the valve portion side opening for communication with the opening of the upper unit body 1120 at the center of the valve portion 1110 if the valve portion 1110 is made of a material different from the upper unit body 1120.

In addition, if the valve portion 1110 is made of a same material as the upper unit body 1120, it may further include a ring of an elastic material such as silicon or rubber or an air blocking surface between the air passage 1210 and the valve portion 1110 in order to effectively close the air passage 1210.

Meanwhile, according to another embodiment of the present disclosure, the valve portion 1110 may also be implemented as a duckbill check valve. If the valve portion 1110 is implemented as the duckbill check valve, the valve portion 1110 is released in such a manner that the discharging device presses the duckbill check valve when the discharging device is coupled with the container, such that the air can flow into the container.

In addition, the discharging device may be leak-proof while the user is pressing the discharging device. That is, when the user has completely pressed the discharging device, the upper portion of the discharging device presses the check valve, such that the content is not discharged.

When the upper portion of the discharging device presses the check valve, the check valve is prevented from being locked by the discharging port.

The upper unit body 1120 is a region where the coupling unit 1000 is coupled with the discharging device when being coupled with the container. The upper unit body 1120 is formed with the upper unit opening 1121 in order to transfer the content to the pouch 2000, and is coupled with the discharging device to function so that the suction force of the discharging device applied for discharging the content can be transferred to the pouch 2000 through the lower unit opening 1220 of the lower unit 1200. The upper unit body 1120 can be implemented to have a certain height and width in order to be air-tightly contacted and coupled with the discharging device.

The upper surface of the upper unit body 1120 is formed with a pressurizing surface B that receives the pressurizing force from the discharging device. The pressurizing surface B is formed to have a planar shape parallel with the direction intersecting with respect to the direction in which the pressurizing force is provided.

When the pressurizing surface B is formed to have a planar shape perpendicular to the direction in which the pressurizing force is provided, the cross-sectional thickness of the upper unit body 1120 can be formed to be the same.

On the other hand, when the pressurizing surface B is formed to have another planar shape other than the planar shape perpendicular to the direction in which the pressurizing force is provided, the thickness of one side of the upper unit body 1120 adjacent to the valve portion 1110 side can be set differently from the thickness of the other side of the upper unit body 1120 that is in contact with the upper unit opening 1121. For example, when the thickness of the one side of the upper unit body 1120 is larger than the thickness of the other side thereof, the pressurizing surface B can be formed to have a planar shape inclined downward toward the upper unit opening 1121.

Meanwhile, according to FIG. 12B, when the upper unit body 1120 receives a predetermined pressurizing force, the opening and closing of the valve portion 1110 can be controlled while the upper unit body 1120 is pushed to the inside of the container.

Since the expanded state of the pouch 2000 should be maintained when the pouch 2000 is expanded in the container in order to fill the content, the depressurized state at the space between the pouch 2000 in the container and the container should be maintained. Therefore, in the state, the valve portion 1110 should be closed to prevent the outside air from flowing into through the valve portion 1110. However, when the discharging device is coupled and the content is discharged from the pouch 2000, the size of the pouch 2000 should also be contracted according to the reduction of the content, such that at this time, the valve portion 1110 should be opened so that the air flows into the container from the outside and the depressurized state in the container can be released.

In order to implement this, when the discharging device is coupled and the pressure is applied to the upper unit body 1120, which intersects with respect to the plane axis at which the upper unit body 1120 is formed, from the discharging device, the upper unit body 1120 is pressed toward the inside (the center) of the upper unit body 1120 to lift the valve portion 1110 to form an open space between the valve portion 1110 and the air passage 1210 so that the air can flow into the container through the air passage 1210. The valve portion 1110 may include a valve portion side connecting portion 1111 connected with the upper unit body 1120 in order to implement such a function.

When the discharging device provides the pressurizing force downward with respect to the pressurizing surface B of the upper unit body 1120, the end portion of the valve portion 1110 connected with the upper unit body 1120 is deformed in a direction opposite to the direction in which the pressurizing force is provided, that is, upward. When the end portion of the valve portion 1110 is deformed upward, the valve portion 1110 is covered thereon before the pressurizing force is applied to the upper unit body 1120, such that the closed air passage 1210 is opened.

The average thickness of the upper unit body 1120 can be formed larger than the average thickness of the valve portion 1110. That is, the upper unit body 1120 can be formed thicker than the valve portion 1110.

Meanwhile, when the pressurizing force is provided to the upper unit body 1120, at least a portion of the upper unit body 1120 is deformed by the pressurizing force to move toward the lower unit opening 1220 side formed at the lower unit 1200, such that the valve portion 1110 can also open the air passage 1210, and according to the modified embodiment, when the pressurizing force is provided to the upper unit body 1120, the valve portion 1110 is pulled toward the upper unit opening 1121 while the upper unit body 1120 is pushed downward, such that the valve portion 1110 can also open the air passage 1210.

The upper unit fastening portion 1130 fixes the pouch 2000 together with the lower unit fastening portion 1230 of the lower unit 1200 so as to couple the pouch 2000 to the coupling unit 1000.

The upper unit fastening portion 1130 can be implemented to have a curved shape rather than a straight-line so that the pouch 2000 can be coupled to the upper unit fastening portion 1130 only by the elasticity of the pouch 2000 without flowing down when the pouch 2000 is fastened. When the upper unit 1100 is fastened to the lower unit 1200, the upper unit 1100 and the lower unit 1200 may have male and female structures, in which the upper unit fastening portion 1130 and the lower unit fastening portion 1230 correspond to each other, so as to firmly couple the upper unit 1100 and the lower unit 1200.

For an exemplary purpose, the upper unit fastening portion 1130 is formed with a projection portion, and the lower unit fastening portion 1230 is formed with a depression portion corresponding to the projection portion. When the upper unit fastening portion 1130 and the lower unit fastening portion 1230 are fastened, the projection portion and the depression portion can be engaged with each other so that the upper unit fastening portion 1130 and the lower unit fastening portion 1230 are firmly coupled to each other. For example, in the process of fastening the upper unit fastening portion 1130 to the lower unit fastening portion 1230, a shape of the projection portion of the upper unit fastening portion 1130 made of an elastic member is deformed, and the projection portion can move to the depression portion side of the lower unit fastening portion 1230. When the projection portion completely moves to the depression portion side, the projection portion is restored to its original shape so that the fastened state of the upper unit fastening portion 1130 and the lower unit fastening portion 1230 are firmly kept until a predetermined force is applied thereto. Although it has been described in the present embodiment that the projection portion is formed at the upper unit fastening portion 1130 and the depression portion is formed at the lower unit fastening portion 1230, a configuration, in which the depression portion is formed at the upper unit fastening portion 1130, and the projection portion corresponding to the depression portion is formed at the lower unit fastening portion 1230, is also possible.

The upper end 1131 of the upper unit fastening portion 1130 can be connected with the valve portion 1110 and the upper unit body 1120. A groove can be formed at the inside of the upper unit 1100 corresponding to the upper end 1131 of the upper unit fastening portion 1130. As described above, when the discharging device is coupled and the upper unit body 1120 receives the pressure vertically from the discharging device, such a structure allows the upper unit body 1120 to be easily pressed to the inside (the center) of the upper unit body 1120, such that the air can flow into the container through the air passage 1210.

The lower end 1132 of the upper unit fastening portion 1130 can project toward the outside of the container. Due to such a structural feature, the pouch 2000 fastened to the coupling unit 1000 is kept to project toward the outside with respect to the discharging device. Thus, even when the content filled in the pouch 2000 are almost exhausted and the side surface of the pouch 2000 is adjacent to the content suction port of the discharging device, the pouch 2000 can prevent the content from being sucked into the content suction port by the suction force of the discharging device.

As illustrated by the dotted lines in FIGS. 12A and 12B, in order to prevent the pouch 2000 from being sucked into the content suction port of the discharging device, the upper unit fastening portion 1130 of the upper unit 1100 can be formed to expand up to a position where the content suction port of the discharging device is formed. Therefore, the expanded upper unit fastening portion 1130 can function as a guide for the pouch 2000, thereby preventing the pouch 2000 from being sucked into the content suction port of the discharging device.

Figure 13:
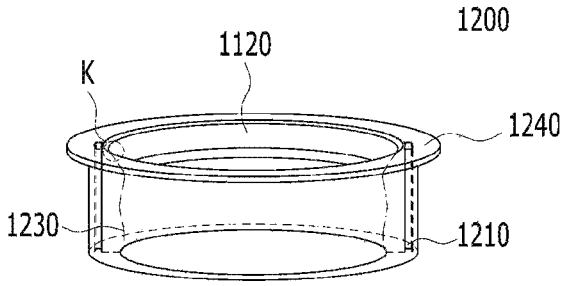
FIG. 13 is a view illustrating a lower unit of the coupling unit according to an embodiment of the present disclosure.

FIG. 13 is a view illustrating a lower unit of the coupling unit according to an embodiment of the present disclosure.

According to FIG. 13, the lower unit 1200 may include the air passage 1210, the lower unit opening 1220, the lower unit fastening portion 1230, and the anti-slip prevention portion 1240.

The lower unit 1200 is directly coupled with the container to perform a function of supporting the coupling unit 1000, and therefore, can be made of a rigid material as compared with the upper unit 1100. When the lower unit 1200 is coupled to the container, a surface where the lower unit 1200 and the container opening directly contact can be air-tightly contacted so that the air cannot flow into and out.

The air passage 1210 is a passage that discharges the air so that the air in the container can be discharged to the outside of the container when the pouch 2000 is expanded to fill the pouch 2000 with the content after the coupling unit 1000 coupled with the pouch 2000 is coupled to the container. In addition, when the content is filled in the pouch 2000 and then the content is discharged to the outside of the container by the discharging device, the air passage 1210 performs a passage function capable of supplying the air outside the container to the container so that the volume of the pouch 2000 corresponding to the amount of the discharged content can be smoothly reduced. According to such a design feature, the surface area of the pouch 2000 can be reduced as the content is reduced, thereby minimizing the amount of the content sticking to the internal wall of the pouch 2000.

The air passage 1210 can have various structures such as a circular shape or an elliptical shape. Two or more air passages 1210 can be provided in consideration of an air discharging speed, etc. The air passage 1210 can be generally implemented smaller than the lower unit opening 1220.

The lower unit opening 1220 can be designed to form space K between the upper end 1131 of the upper unit fastening portion 1130 and the lower unit opening 1220 when the upper unit 1100 and the lower unit 1200 are coupled. At this time, an end protrusion 2100 of the pouch 2000 is positioned in space A between the upper end 1131 of the upper unit fastening portion 1130 and the lower unit opening 1220, and the width thereof can be designed to get narrower downward in order to be locked between the upper unit fastening portion 1130 and the lower unit fastening portion 1230.

In addition, as described above, when the discharging device is coupled and the upper unit body 1120 receives the pressure vertically from the discharging device, space K can provide a space so that the upper unit body 1120 can be easily pressed to the inside (the center) of the upper unit body 1120.

The lower unit fastening portion 1230 can be implemented to correspond to the upper unit fastening portion 1130 with a male and female shape so that the fastened state can be kept without being released when being coupled with the upper unit fastening portion 1130. At this time, although the lower unit fastening portion 1230 and the upper unit fastening portion 1130 are not a straight-line, the lower unit fastening portion 1230 and the upper unit fastening portion 1130 can have constant ductility, thereby being fitted therein vertically. When the lower unit fastening portion 1230 and the upper unit fastening portion 1130 are coupled, the space between the lower unit fastening portion 1230 and the upper unit fastening portion 1130 can be designed to have a spacing state corresponding to the thickness of the pouch 2000.

The lower unit 1200 may further include the anti-slip prevention portion 1240. The anti-slip prevention portion 1240 prevents the coupling unit 1000 from being pushed into the container by the pressure generated by the coupling of the discharging device when the coupling unit 1000 is coupled to the container and the discharging device is coupled with the coupling unit 1000.

Although it is illustrated in FIG. 13 that the anti-slip prevention portion 1240 has a shape protruding from the upper end of the lower unit 1200, the shaped of the anti-slip prevention portion 1240 is not limited thereto and can also be implemented to have shapes of various structures, for example, a shape such as a ring or a hook formed at the outside of the lower unit 1200, which can prevent the coupling unit 1000 from being pushed into the container.

Figure 14A:
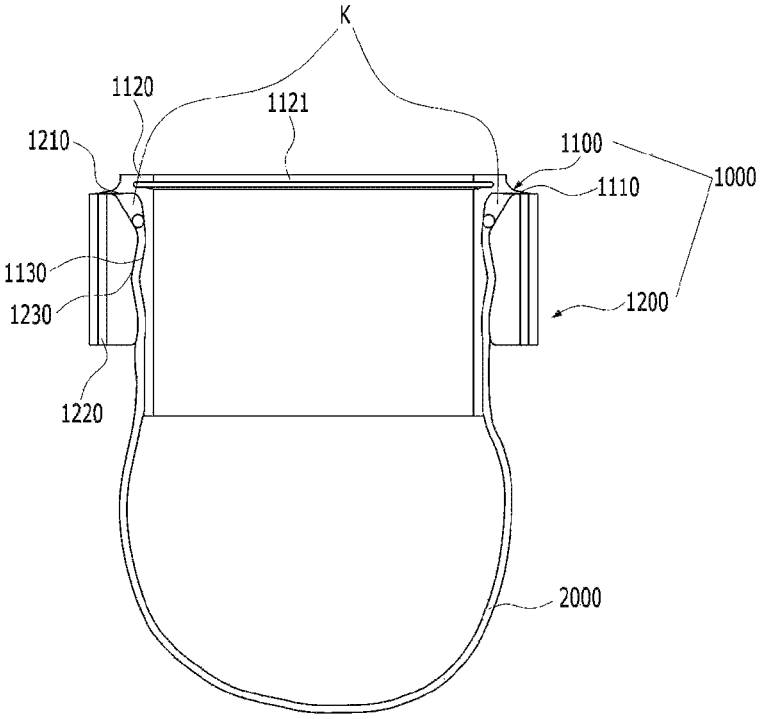
FIGS. 14A and 14B are views illustrating the coupling unit which is coupled to the pouch according to an embodiment of the present disclosure.
Figure 14B:
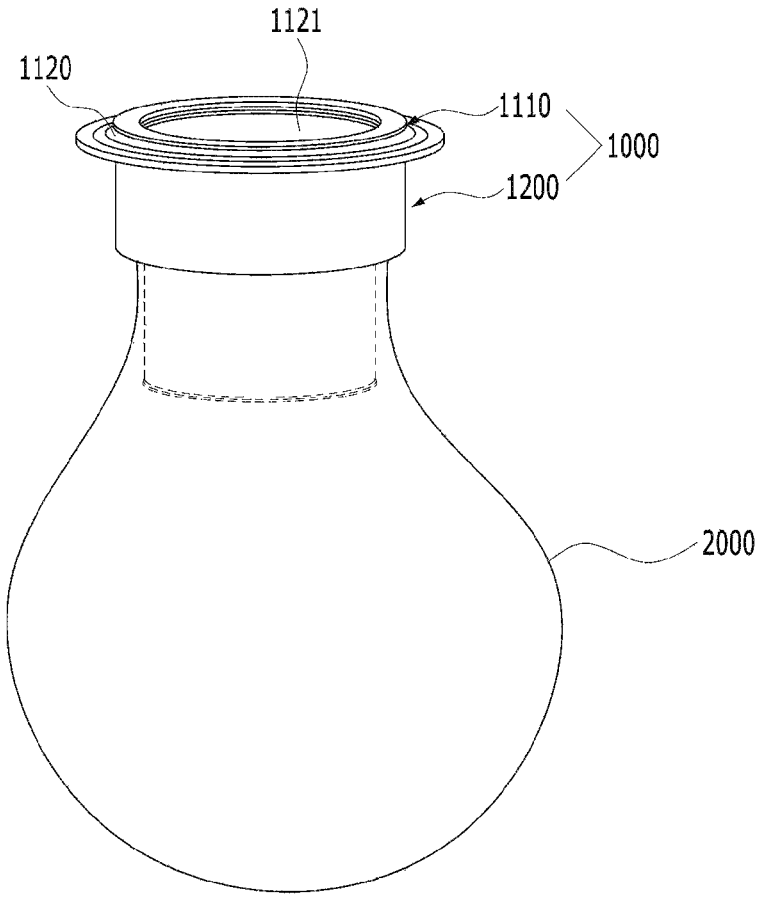

FIGS. 14A and 14B are views illustrating the coupling unit which is coupled to the pouch according to an embodiment of the present disclosure. FIG. 14A is a cross-sectional view of the coupling unit which is coupled to the pouch according to an embodiment of the present disclosure. FIG. 14B is a perspective view of the coupling unit which is coupled to the pouch according to an embodiment of the present disclosure.

According to FIGS. 14A and 14B, the pouch 2000 is coupled between the upper unit 1100 and the lower unit 1200 of the coupling unit 1000. In order to couple the pouch 2000 to the coupling unit 1000, the pouch 2000 is first fitted into the upper unit 1100 and the lower unit 1200 is fastened to the upper unit 1100 to which the pouch 2000 is fitted.

At this time, the upper unit 1100 and the lower unit 1200 may have male and female shapes, corresponding to each other. Due to such a structural feature, the upper unit 1100 and the lower unit 1200 can be firmly coupled, and the pouch 2000 can be kept coupled to the coupling unit 1000.

When the upper unit 1100 is coupled to the lower unit 1200, the upper unit opening 1121 of the upper unit 1100 and the lower unit opening 1220 of the lower unit 1200 communicate with each other. At this time, the size of the upper unit opening 1121 may be formed smaller than the size of the lower unit opening 1220 and at least a portion of the upper unit fastening portion 1130 may overlap with the lower unit fastening portion 1230.

A space corresponding to the thickness of the pouch 2000 may be formed between the upper unit 1100 and the lower unit 1200 so that the pouch 2000 may be coupled thereto. In particular, space K may be formed for an operation of the valve portion 1110. Space K between the upper end 1131 of the upper unit fastening portion 1130 and the lower unit opening 1220 may be designed to get narrower in width downward so that the end protrusion 2100 of the pouch 2000 is not separated from the coupling unit 1000.

According to such a structural feature, after the pouch 2000 is coupled to the coupling unit 1000 and inserted into the container, gas is received through the upper unit opening 1121 or the pressure in the container is lowered. When the pouch 2000 receives the pressure toward the inside of the container, the pouch 2000 is pushed to a point where the distance between the upper unit 1100 and the lower unit 1200 of the coupling unit 1000 is equal to the thickness of the end protrusion 2100 and contacts the coupling unit 1000, thereby completely blocking the air from moving between the upper unit 1100 and the lower unit 1200.

Figure 15:
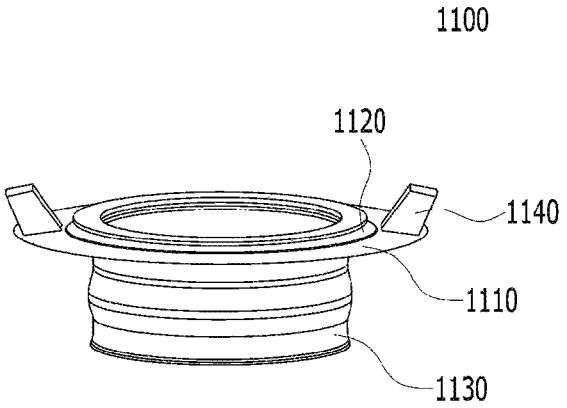
FIG. 15 is a view illustrating an upper unit of a coupling unit according to another embodiment of the present disclosure.

FIG. 15 is a view illustrating an upper unit of a coupling unit according to another embodiment of the present disclosure. In the description of the modified embodiment, a detailed description of the same configuration will be omitted.

According to FIG. 15, the upper unit 1100 of the coupling unit 1000 may include arms 1140 that can push the valve portion 1110 by the pressure applied by the discharging device to the upper unit 1100 by the coupling of the discharging device, thereby opening the valve portion 1110.

At this time, in order for the arms 1140 to receive the pressure by the coupling of the container and the discharging device, each of the end portion of the arms 1140 should be extended to a position higher than the horizontal extension line of the upper unit body 1120, and the upper unit body 1120 can be designed to have a certain height in order to secure a space where the valve portion 1110 can be opened by the pressure applied by the discharging device to the arm 1140.

Figure 16:
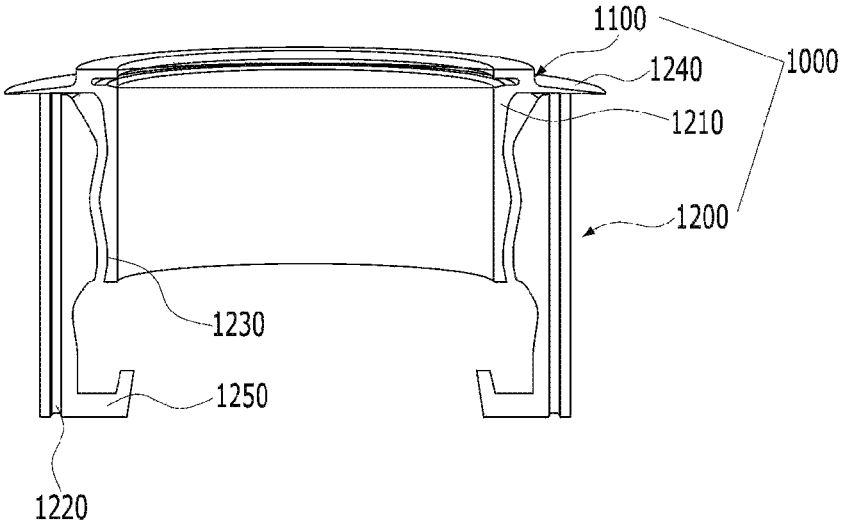
FIG. 16 is a view illustrating a lower unit of the coupling unit according to another embodiment of the present disclosure.

FIG. 16 is a view illustrating a lower unit of the coupling unit according to another embodiment of the present disclosure. In the description of the modified embodiment, a detailed description of the same configuration will be omitted.

According to FIG. 16, the lower unit 1200 may include a pouch fastening portion 1250 so that the pouch 2000 can be coupled to the lower unit 1200. In this case, the upper unit 1100 is directly coupled to the lower unit 1200, and the lower unit can couple the pouch 2000 to the coupling unit 1000 by way of locking the pouch 2000 to the pouch fastening portion 1250 formed toward the center thereof. In such a design, the upper unit 1100 does not need to have a separate upper unit fastening portion 1130, and the pouch 2000 can simply be coupled to the coupling unit 1000 with the lower unit 1200.

According to such a design feature, the coupling unit 1000 can be coupled with the container and fix it by inserting the pouch 2000 into the container, and can control the air to flow into and out the container, thereby expanding the pouch 2000 in the container for easily filling the content and keeping it, and also reducing the surface area according to the reduction of the content to minimize the amount of the content sticking to the internal wall of the pouch 2000.

Figure 17:
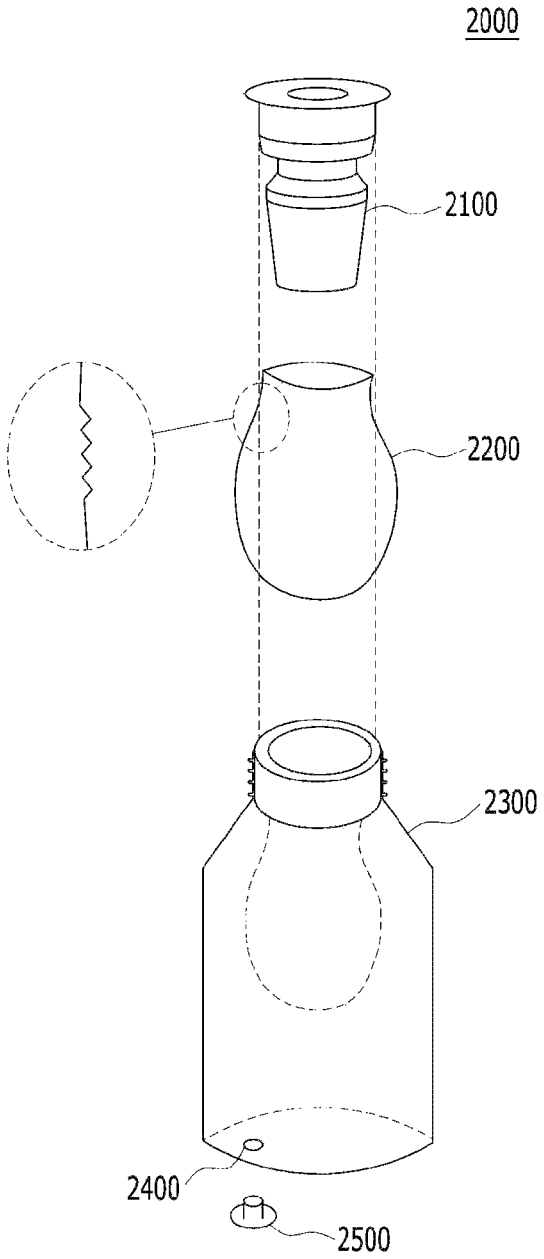
FIG. 17 is a view illustrating a container device according to an embodiment of the present disclosure.

FIG. 17 is a view illustrating a container device 2000 according to an embodiment of the present disclosure. The container device 2000 according to the present disclosure may include a coupling unit 2100, a pouch 2200, a rigid container 2300, an air passage 2400, and an air passage cap 2500.

The coupling unit 2100 performs a function of coupling the pouch 2200 to the rigid container 2300. The coupling unit 2100 is air-tightly contacted and coupled to the opening of the pouch 2200 with the opening of the rigid container 2300 so that the content does not flow into the rigid container 2300 and can be all filled in the pouch 2200 as the content is filled through the opening of the rigid container 2300 when the pouch 2200 is inserted into the rigid container 2300, thereby to prevent the air in the rigid container 2300 from being discharged between the pouch 2200 and the rigid container 2300.

Meanwhile, according to another embodiment of the present disclosure, in addition to the method for fastening the pouch 2200 and the rigid container 2300 using the coupling unit 2100, the pouch 2200 and the rigid container 2300 may be fastened by the high frequency welding or the adhesive agent. In the case of using the high frequency welding or the adhesive agent, the opening of the pouch 2200 can contact the opening of the rigid container 2300 without using the coupling unit 2100, and then the pouch 2200 may be coupled to the rigid container 2300 through the high frequency welding or the adhesive application.

The pouch 2200 is made of a flexible material with elasticity and has one side opened to be coupled with the coupling unit 2100. The pouch 2200 can be, for example, made of a material such as synthetic latex, silicone, silicon carbonate, natural rubber, or polyisoprene, and in addition, can also be made of any material as long as it is a packing material with the elasticity and capable of containing liquid.

As illustrated in the dotted circle of FIG. 17, the pouch 2200 can have wrinkles of a certain pattern at a portion directly below the portion that is coupled with the coupling unit 2100 according to an embodiment of the present disclosure. By providing the wrinkles, even when the content of the pouch 2200 are almost discharged and the pouch 2200 is contracted to its original volume or less, the wrinkle guides so that the pouch 2200 is folded to have a predetermined shape, thereby preventing the pouch 2200 from being irregularly folded or rolled toward the opening of the rigid container 2300 to expect more effective content discharging.

The pouch 2200 before expansion can have a volume smaller than the volume of the rigid container 2300 so that the volume of the pouch 2200 can be expanded in the rigid container 2300. When the pouch 2200 is expanded, the restoring force for returning to its original shape by the elastic recovery force is generated. The restoring force can keep the volume of the pouch 2200 to accommodate the amount of the residual content, thereby not only minimizing the volume of the pouch 2200 in which the content is filled to minimize the amount of the content sticking to the internal wall of the pouch 2200, but also applying the pressure thereto so that the content in the pouch 2200 can be easily discharged.

Therefore, it is preferable that the volume of the pouch 2200 before being inflated and expanded by the content is implemented smaller than the volume of the rigid container 2300.

The rigid container 2300 provides a space in which the pouch 2200 can be expanded. The rigid container 2300 can be implemented by the injection molding or the blowing molding method in the case of a plastic material, and alternatively, can also be made of glass, ceramic, or metal material. The rigid container 2300 prevents the pouch 2200 from being damaged to leak the content when the content is filled in the pouch 2200 made of a flexible material.

The air passage 2400 functions so that the air in space A between the pouch 2200 and the rigid container 2300 can be discharged by the pouch 2200 expanded when the coupling unit 2100 couples the pouch 2200 with the rigid container 2300 to apply the pressure to the inside of the pouch 2200. In addition, when the content is discharged from the pouch 2200 filled with the content, the depressurized state in the rigid container 2300 should be released so that the volume of the pouch 2200 can be reduced as the content of the pouch 2200 reduces, and in order to implement this, the air passage 2400 functions so that the air outside the rigid container 2300 can flow into the rigid container 2300.

Although it has been illustrated in FIG. 17 that the air passage 2400 is formed at the rigid container 2300, the air passage 2400 can also be formed at the coupling unit 2100 according to an embodiment of the present disclosure.

The air passage cap 2500 functions so that the air in space A between the pouch 2200 and the rigid container 2300 is discharged to perform the depressurization for space A, and then the air outside the rigid container 2300 is prevented from flowing into the rigid container 2300 to keep the depressurized state of space A so that the pouch 2200 can keep the expanded state. The air passage cap 2500 can be implemented as a valve, an air cap, etc., and in addition, a seal of a sticker type, etc. having the adhesive force capable of sufficiently withstanding the air inflow pressure into the air passage 2400 can be considered.

Furthermore, the air passage cap 2500 can also be implemented to have a structure in which the air passage cap 2500 is released when the pressure in the rigid container 2300 increases as the volume of the pouch 2200 reduces and the pressure of a certain magnitude or more is applied to the air passage cap 2500.

Figure 18:
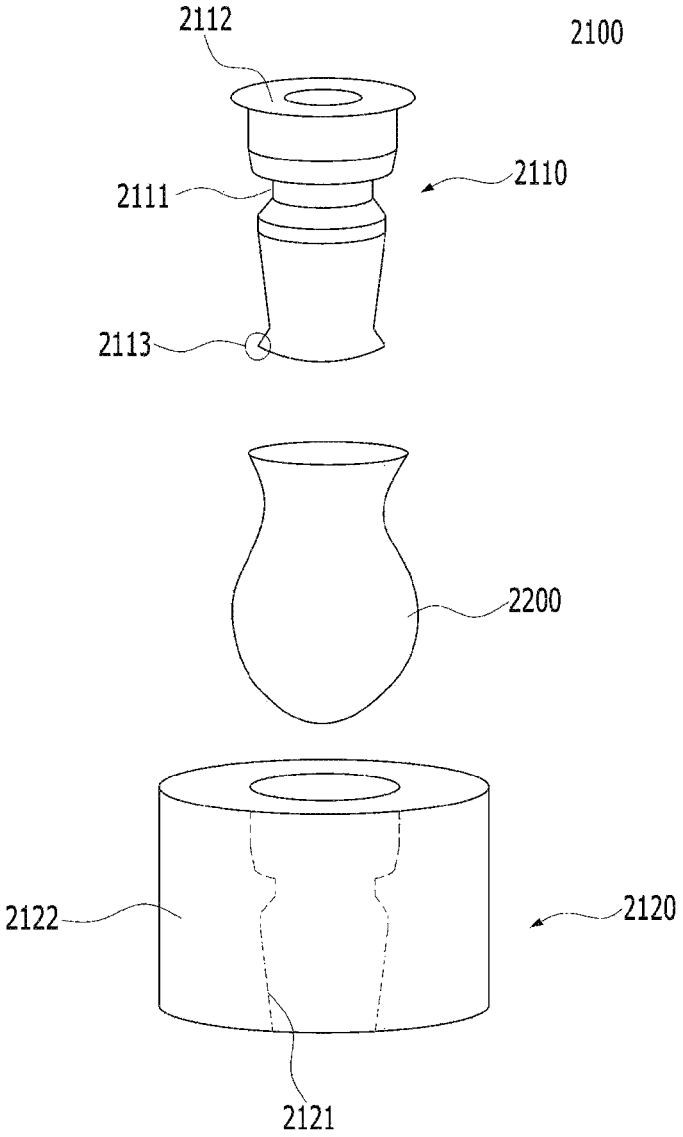
FIG. 18 is a view illustrating a coupling unit according to an embodiment of the present disclosure.

FIG. 18 is a view illustrating a coupling unit 2100 according to an embodiment of the present disclosure.

According to FIG. 18, the coupling unit 2100 may include an upper unit 2110 and a lower unit 2120. The upper unit 2110 may include an upper unit fastening portion 2111, an anti-slip prevention portion 2112, and a pouch expansion guiding portion 2113, and the lower unit 2120 may include a lower unit fastening portion 2121 and a coupling unit fixing portion 2122.

The upper unit fastening portion 2111 may be designed so that the upper unit 2110 and the lower unit 2120 of the coupling unit 2100 can be coupled while fixing the pouch 2200 by having the pouch 2200 fitted therein and being coupled with the lower unit fastening portion 2121. At this time, the upper unit fastening portion 2111 may be formed with a projection portion or a depression portion formed to be depressed corresponding to the lower unit fastening portion 2121 so that the pouch 2200 can be firmly fixed between the upper unit 2110 and the lower unit 2120.

The anti-slip prevention portion 2112 prevents the coupling unit 2100 from being pushed into the container by the pressure generated by the coupling of the discharging device when the coupling unit 2100 is coupled to the container and the discharging device is coupled with the coupling unit 2100. The anti-slip prevention portion 2112 can also be implemented at the lower unit 2120 according to the implementation of the spirit of the present disclosure.

The pouch expansion guiding portion 2113 is designed to project toward the outside of the container, thereby preventing a portion connected with the upper unit 2110 from being sucked into the container discharging port when the pouch 2200 has been coupled to the upper unit 2110. That is, due to such a structural feature, the pouch 2200 fastened to the coupling unit 2100 is kept to project toward the outside with respect to the discharging device, thereby preventing the pouch 2200 from being sucked into the content suction port by the suction force of the discharging device even when the content filled in the pouch 2200 are almost exhausted and the side surface of the pouch 2200 is adjacent to the content suction port of the discharging device.

The lower unit fastening portion 2121 can be coupled with the upper unit fastening portion 2111 on the pouch 2200 put on the upper unit fastening portion 2111. The lower unit fastening portion 2121 can be formed with a projection portion or a depression portion formed to be depressed corresponding to the upper unit fastening portion 2111 so that the pouch 2200 can be firmly fixed between the upper unit 2110 and the lower unit 2120.

The coupling unit fixing portion 2122 is designed so that the coupling unit 2100 can be firmly fixed to the rigid container 2300. For this purpose, the coupling unit fixing portion 2122 can be implemented as a ring-shaped protrusion, and can also be made of a material that can shield the air such as silicon according to the design.

The coupling unit 2100 can be inserted into the opening of the rigid container 2300 to use by coupling a typical discharging device even without adding a separate device to the rigid container 2300 or its design change.

Figure 19:
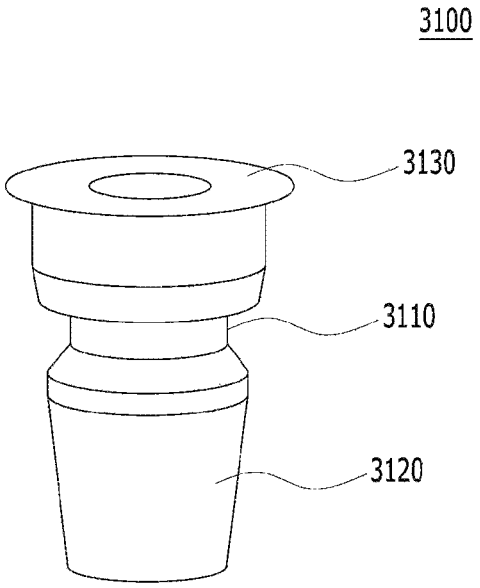
FIG. 19 is a view illustrating a coupling unit according to another embodiment of the present disclosure.

FIG. 19 is a view illustrating a coupling unit 3100 according to another embodiment of the present disclosure.

Referring to FIG. 19, the coupling unit 3100 according to another embodiment of the present disclosure can be implemented to have a single body, and may include a pouch binding portion 3110, a coupling unit fixing portion 3120, and an anti-slip prevention portion 3130.

The pouch binding portion 3110 is a region in which the pouch 2200 is directly coupled to the coupling unit 3100 and can be formed to be relatively depressed as compared with the coupling unit fixing portion 3120. Therefore, it is possible to prevent the pouch 2200 from being easily peeled off from the coupling unit 3100 by the elastic force of the pouch 2200 when the pouch 2200 is put on the coupling unit 3100.

The coupling unit fixing portion 3120 functions so that the coupling unit 3100 can be firmly coupled to the rigid container 2300. In addition, the coupling unit fixing portion 3120 is coupled to the inside of the opening of the rigid container 2300 so that the pouch 2200 put on the pouch binding portion 3110 is locked between the internal wall of the rigid container 2300 and the coupling unit fixing portion 3120 when flowing down, thereby preventing the pouch 2200 from flowing down.

The anti-slip prevention portion 3130 prevents the coupling unit 3100 from being pushed into the container by the pressure generated by the coupling of the discharging device when the coupling unit 3100 is coupled to the container and the discharging device is coupled with the coupling unit 3100.

The coupling unit 3100 can be inserted into the opening of the rigid container 2300 and can be used by coupling a typical discharging device even without adding a separate device to the rigid container 2300 or its design change.

The coupling units 2100, 3100 illustrated in FIGS. 18 and 19 are only one embodiment for the implementation of the present disclosure, and although it has been designed unlike the coupling unit 2100, 3100 illustrated in FIG. 18 or 19, it should be construed as being included in the spirit of the present disclosure as long as it is a configuration for airtightly contacting and coupling the pouch 2200 to the rigid container 2300.

Figure 20A:
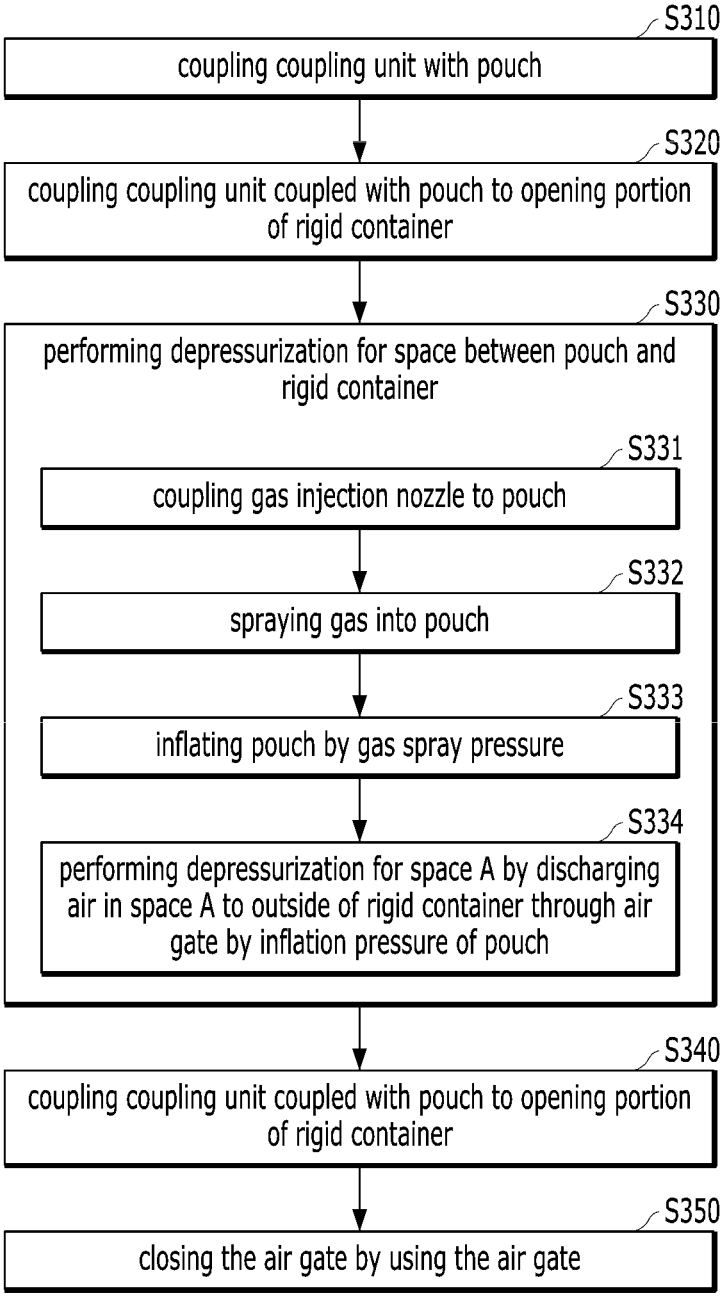
FIG. 20A is a view illustrating a manufacturing procedure of a container device according to an embodiment of the present disclosure.

FIG. 20A is a view illustrating a manufacturing procedure of the container device 2000 according to an embodiment of the present disclosure.

Figure 20B:
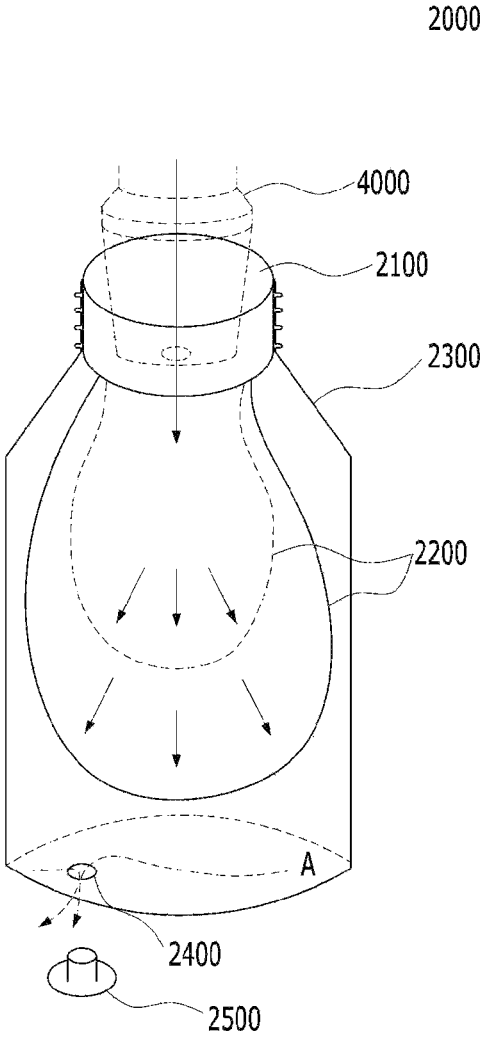
FIG. 20B is a view illustrating the coupled shape of the container device according to an embodiment of the present disclosure.

FIG. 20B is a view illustrating the coupled state of the container device 2000 according to an embodiment of the present disclosure.

As illustrated in FIGS. 20A and 20B, in order to implement the container device 2000 according to an embodiment of the present disclosure, the coupling unit 2100 and the pouch 2200 are first coupled S310.

The coupling unit 2100 coupled with the pouch 2200 is inserted into and firmly fixed to the opening of the rigid container 2300 S320. The pouch 2200 is also inserted into the rigid container 2300 when the coupling unit 2100 is inserted into the opening of the rigid container 2300, and the coupling unit 2100 and the rigid container 2300 are coupled, such that the air between the pouch 2200 and the rigid container 2300 can be discharged to the outside of the rigid container 2300 only through the air passage 2400.

When the pouch 2200 is coupled to the rigid container 2300 by the coupling unit 2100, a depressurizing procedure for space A between the pouch 2200 and the rigid container 2300 is performed S330. A gas or liquid injection nozzle 4000 is coupled to the pouch 2200 in order to depressurize space A S331, and the gas or liquid is sprayed into the pouch 2200 S332. When the gas or liquid is sprayed into the pouch 2200, the pouch 2200 is inflated by the spray pressure S333. When the pouch 2200 is inflated in the rigid container 2300, the air in space A is discharged to the outside of the rigid container 2300 through the air passage 2400 by the inflation pressure of the pouch 2200, and therefore, space A in the rigid container 2300 is depressurized S334.

When the pouch 2200 sufficiently inflates in the rigid container 2300 and the volume of space A becomes sufficiently small, the depressurizing procedure is terminated S340. In order to determine whether the volume of space A in the rigid container 2300 has become sufficiently small, it can be determined by designing so that the coupling between the pouch 2200 and the gas or liquid injection nozzle 4000 is released when the pressure applied to the inside of the pouch 2200 exceeds a certain magnitude, or previously calculating whether the volume of space A has become sufficiently small by previously inputting the volume of the rigid container 2300 to inject the amount of gas or liquid corresponding to the corresponding volume into the pouch 2200 through the gas injection nozzle 4000.

When the depressurizing procedure is completed, the air passage 2400 is closed by using the air passage cap 2500 to keep the depressurized state (the vacuum state) of space A S350. The air passage cap 2500 can be implemented as a valve, an air cap, etc., as a method for sealing the air passage 2400 and in addition, a seal, etc. having the adhesive force capable of sufficiently withstanding the air inflow pressure into the air passage 2400 can be considered.

Since the pouch 2200 can be expanded and kept in a shape of the rigid container 2300 when the air passage 2400 is closed, the content can be filled into the pouch 2200 using a typical content filling method without modification.

That is, the air passage cap 2500 can keep the depressurized state of the internal space of the rigid container 2300 by sealing the air passage 2400.

A portion of the air passage cap 2500 covers the air passage 2400, thereby suppressing the air from being received through the air passage 2400 from the outside of the rigid container 2300 when the depressurization between the pouch 2200 and the rigid container 2300 is performed. Therefore, when the content is received through the container opening, the pouch 2200 can become the expanded state so that the content can be filled into the pouch 2200 by the desired volume.

When the air passage 2400 is sealed by the air passage cap 2500, the pressure of the internal space of the pouch 2200 is formed smaller than the restoring force of the pouch 2200, and the force $P_1$ operating on the inner surface of the pouch 2200 by the pressure of the internal space of the pouch 2200 and the force $P_2$ operating on the outer surface of the pouch 2200 by the pressure of the space between the pouch 2200 and the rigid container 2300 are in equilibrium with the restoring force of the pouch 2200. That is, the combined force of the force $P_1$ operating on the inner surface of the pouch 2200 and the force $P_2$ operating on the outer surface of the pouch 2200 can be in equilibrium with the restoring force of the pouch 2200, thereby keeping the expanded state of the pouch 2200.

At this time, one side of the air passage cap 2500 contacts the inside of the rigid container 2300, and the other side of the air passage cap 2500 contacts the atmosphere.

When the content is filled into the pouch 2200 in the rigid container 2300, the discharging device can be coupled to the rigid container 2300. The discharging device performs a function of discharging the content in the pouch 2200, and can be variously implemented in a pump type, a nozzle type, and a cap type according to the application of the product, etc.

[Adjustment of the Content Discharging Speed Using the Restoring Force]

As the volume expands, the pouch 2200 operates the restoring force for restoring to its original state again. The restoring force can generate the pressure that can easily discharge the content in the pouch 2200 even without using a pump, etc. At this time, the restoring force of the pouch 2200 can be controlled according to the basic size of the pouch 2200, the thickness and the physical property of the pouch 2200, and the shape of the pouch 2200 before expansion, thereby adjusting the speed and the amount of discharging the content.

That is, when the content is filled in the pouch 2200, the elastic force of the pouch 2200 is formed larger than the load of the content filled in the pouch 2200. When the air passage cap 2500 is removed from the air passage 2400 when the opening of the pouch 2200 is open to the outside, the pouch 2200 can be contracted by the elastic force, thereby pushing the content to the outside of the pouch 2200.

Figure 21:
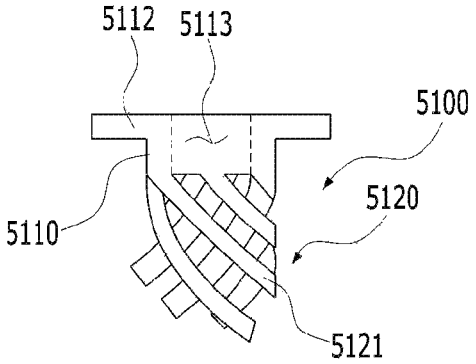
FIG. 21 is a view illustrating a coupling unit including a discharging port clogging prevention portion according to an embodiment of the present disclosure.
Figure 22:
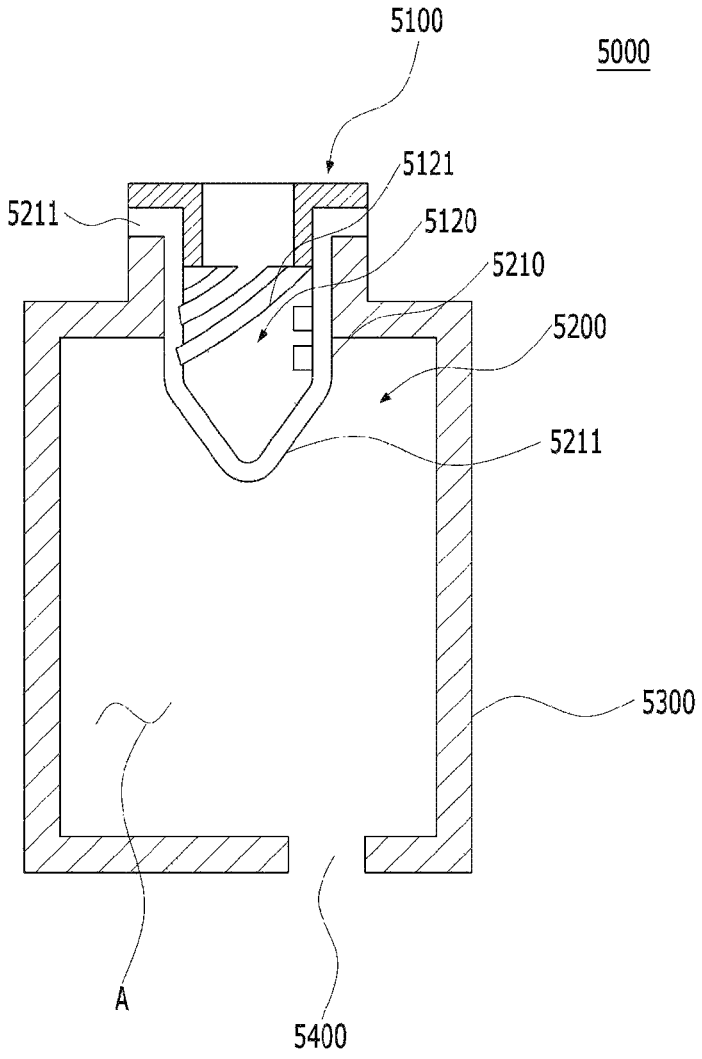
FIG. 22 is a view illustrating a container device to which the coupling unit of FIG. 21 is applied.

FIG. 21 is a view illustrating a coupling unit including a discharging port clogging prevention portion according to an embodiment of the present disclosure, and FIG. 22 is a view illustrating a container device to which the coupling unit of FIG. 21 is applied.

Referring to FIGS. 21 and 22, a coupling unit 5100 of a container 5000 according to the present embodiment includes a coupling unit body 5110 and a discharging port clogging prevention portion 5120.

The coupling unit body 5110 includes a head portion 5112 that is locked at the opening side of a rigid container 5300 of the container 5000 and a coupling unit side opening 5113 for communicating with the internal space of a pouch 5200 by passing through the center of the head portion 5112. The air passage 5400 is formed at the bottom surface of the rigid container 5300.

The discharging port clogging prevention portion 5120 is positioned at the lower end side of the coupling unit body 5110, and includes a plurality of clogging prevention frames 5121 formed to have a spiral shape and elastically deformable.

The discharging port clogging prevention portion 5120 can be formed to have a cylinder shape with the diameter corresponding to the diameter of the coupling unit side opening 5113, and the clogging prevention frames 5121 formed to have a spiral shape form the outer shape of the discharging port clogging prevention portion 5120.

When the discharging device such as a pump or a dispenser is coupled to the container 5000 having the content filled into the pouch 5200, in a procedure of discharging the content to the outside by the discharging device, when the volume of the pouch 5200 is gradually reduced and the end 5211 of the pouch 5200 is adjacent to the coupling unit side opening 5113, the end 5211 of the pouch 5200 or another portion of the pouch 5200 can be inserted into the discharging device side by the discharging pressure of the discharging device, thereby disturbing the discharging of the content. In addition, when the volume of the pouch 5200 is unevenly reduced, the passage between the coupling unit side opening 5113 and the residual content can be clogged when the residual content remains in the pouch 5200, thereby not normally performing the discharging of the content.

Therefore, the discharging port clogging prevention portion 5120 of the container 5000 according to the present embodiment can secure the connection space between the internal space of the pouch 5200 and the coupling unit side opening 5113, in a procedure of discharging the content while the pouch 5200 is contracted, thereby performing the discharging of the content up to the time point when the residual content is minimized.

In addition, in a procedure in which the pouch 5200 is contracted, the spiral-shaped clogging prevention frames 5121 of the discharging port clogging prevention portion 5120 are elastically deformed, such that the discharging port clogging prevention portion 5120 can be deformed into a hemispherical shape, for example. At this time, although the content flow from the internal space of the pouch 5200 to the discharging device side through the space between the clogging prevention frames 5121, the end portion 5211 of the pouch 5200 or another portion thereof is inserted into the discharging device or the coupling unit side opening 5113 side, thereby suppressing the discharging passage of the liquid content from being clogged.

Although it has been described in the present embodiment that the clogging prevention frame 5121 is formed to have a spiral shape, a configuration, in which the clogging prevention frame 5121 is formed to have a shape such as a mesh, can also be included in an embodiment of the present disclosure.

As described above, while the embodiments of the present disclosure have been described with reference to the accompanying drawings, the present disclosure is not necessarily limited to these embodiments, and various modifications can be made without departing from the technical spirit of the present disclosure. Therefore, the embodiments disclosed in the present disclosure are intended to illustrate rather than limit the technical spirit of the present disclosure, and the scope of the technical spirit of the present invention is not limited by these embodiments. Therefore, it should be understood that the above-described embodiments are illustrative in all aspects and not restrictive. The protection scope of the present disclosure should be construed according to the appended claims, and all technical spirit within the scope of equivalents should be construed as being included in the claims of the present disclosure.

Embodiments of the disclosure have been described in the above best mode for embodying the disclosure.

INDUSTRIAL APPLICABILITY

The present disclosure relates to a container device capable of storing liquid and a manufacturing method thereof, and is applicable to a container or a manufacturing method of the container, which can store and discharge various types of liquids, and is industrially applicable with its repetitive possibility.

The invention claimed is:

1. A container device capable of storing liquid, comprising:

a pouch having an elastic property;

a rigid container having a rigid case compared to the pouch and having a container opening at one side thereof;

a coupling unit coupled to the container opening and for coupling an opening of the pouch with the container opening to discharge substance contained in the pouch through a discharge path;

an air passage formed at the rigid container or the coupling unit; and an air passage cap configured to seal the air passage, wherein, when a pressure is applied to an inside of the pouch to increase a volume of the pouch, a volume of a space between the pouch and the rigid container is reduced by an amount equal to the increase in the volume of the pouch, such that air in the space is discharged to the outside of the rigid container through an output path via the air passage to perform depressurization of the space, wherein the discharge path is separate from the output path, and wherein the air passage cap seals the air passage to keep the depressurized state of the space.

2. The container device capable of storing liquid of claim 1, wherein the pouch is inflated to fit in the case of the rigid container when the air in the space is discharged to the outside of the rigid container through the air passage.

3. The container device capable of storing liquid of claim 1, wherein a wrinkle pattern is provided on at least a portion of the pouch.

4. The container device capable of storing liquid of claim 1, wherein the coupling unit is inserted into and fixed to the container opening of the rigid container.

5. The container device capable of storing liquid of claim 4, wherein the coupling unit comprises an upper unit and a lower unit, and the upper unit is connected to communicate with the pouch, and the lower unit is coupled to the upper unit on the pouch.

6. The container device capable of storing liquid of claim 4, wherein the coupling unit comprises a single body, and comprises a pouch binding portion and a coupling unit fixing portion.

* * * * *